US005901720A

United States Patent [19]

Lange

[11] Patent Number: 5,901,720

[45] Date of Patent: May 11, 1999

[54] APPARATUS FOR APPLYING FLUIDS TO VERTICAL SURFACES NONMANUALLY AND PERFORMING OTHER NONMANUAL TASKS ADJACENT VERTICAL SURFACES

[75] Inventor: Michael R. Lange, Minnetonka, Minn.

[73] Assignee: Sky Robotics, Inc., St. Paul, Minn.

[21] Appl. No.: 08/918,464

[22] Filed: Aug. 26, 1997

Related U.S. Application Data

[60] Provisional application No. 60/032,706, Dec. 12, 1996, and provisional application No. 60/024,914, Aug. 30, 1996.

[51] Int. Cl.[6] ..... B08B 3/02

[52] U.S. Cl. ..... 134/172; 118/307; 239/752

[58] Field of Search ..... 134/172; 15/50.1, 15/50.3, 52.2, 103; 118/207, 305; 239/750, 751, 752, 753; 451/92, 2; 114/222

[56] References Cited

U.S. PATENT DOCUMENTS

| | | | |
|---|---|---|---|
| 2,098,262 | 11/1937 | Temple . | |
| 2,718,656 | 9/1955 | Kirk . | |
| 2,729,918 | 1/1956 | Van Denburgh | 451/92 |
| 2,744,494 | 5/1956 | Chappen | 118/305 |
| 3,056,153 | 10/1962 | Laughter | 15/50.1 |
| 3,104,499 | 9/1963 | Hirons | 451/2 |
| 3,298,052 | 1/1967 | Wolfe | 15/103 X |
| 3,454,976 | 7/1969 | Kijinski . | |
| 3,497,902 | 3/1970 | Hartigan . | |
| 3,646,630 | 3/1972 | Russell . | |
| 3,750,686 | 8/1973 | Cook . | |
| 3,775,804 | 12/1973 | Hoener, Jr. . | |
| 3,847,753 | 11/1974 | Baird et al. | 134/172 X |
| 3,863,393 | 2/1975 | Goff | 118/305 X |
| 3,984,944 | 10/1976 | Maasberg et al. . | |
| 4,112,535 | 9/1978 | Wild et al. | 134/172 X |
| 4,417,542 | 11/1983 | Bellafiore | 118/305 X |
| 5,240,503 | 8/1993 | Levy et al. | 451/92 X |
| 5,249,326 | 10/1993 | Jefferies et al. | 451/92 X |
| 5,419,734 | 5/1995 | Van Sickle | 451/92 X |
| 5,629,766 | 5/1997 | Zhadanov et al. . | |

FOREIGN PATENT DOCUMENTS

| | | | |
|---|---|---|---|
| 250862 | 4/1964 | Australia | 15/50.3 |

OTHER PUBLICATIONS

"Water Jet" brochure, Landa, Inc.—Sep., 1995.

"Whisper Wash" advertisement, Power Washers of North America, *Cleaner Times*–Mar., 1998.

*Primary Examiner*—Philip R. Coe

*Attorney, Agent, or Firm*—Dorsey & Whitney LLP

[57] ABSTRACT

The present invention relates to an apparatus for performing nonmanual tasks on and adjacent vertical or nearly vertical surfaces. The apparatus is designed so that a portion of the apparatus can traverse the vertical or nearly vertical surfaces of structures which may include obstacles such as window frames or gaps created by window seams, without coming into physical contact with those surfaces. The apparatus includes a top control unit, a vehicle for traversing the vertical or near vertical surfaces, and a bottom control unit. The vehicle is maintained in a near constant spaced relationship to vertical or nearly vertical surfaces by elongated flexible members that connect the vehicle to the top control unit and bottom control unit.

21 Claims, 20 Drawing Sheets

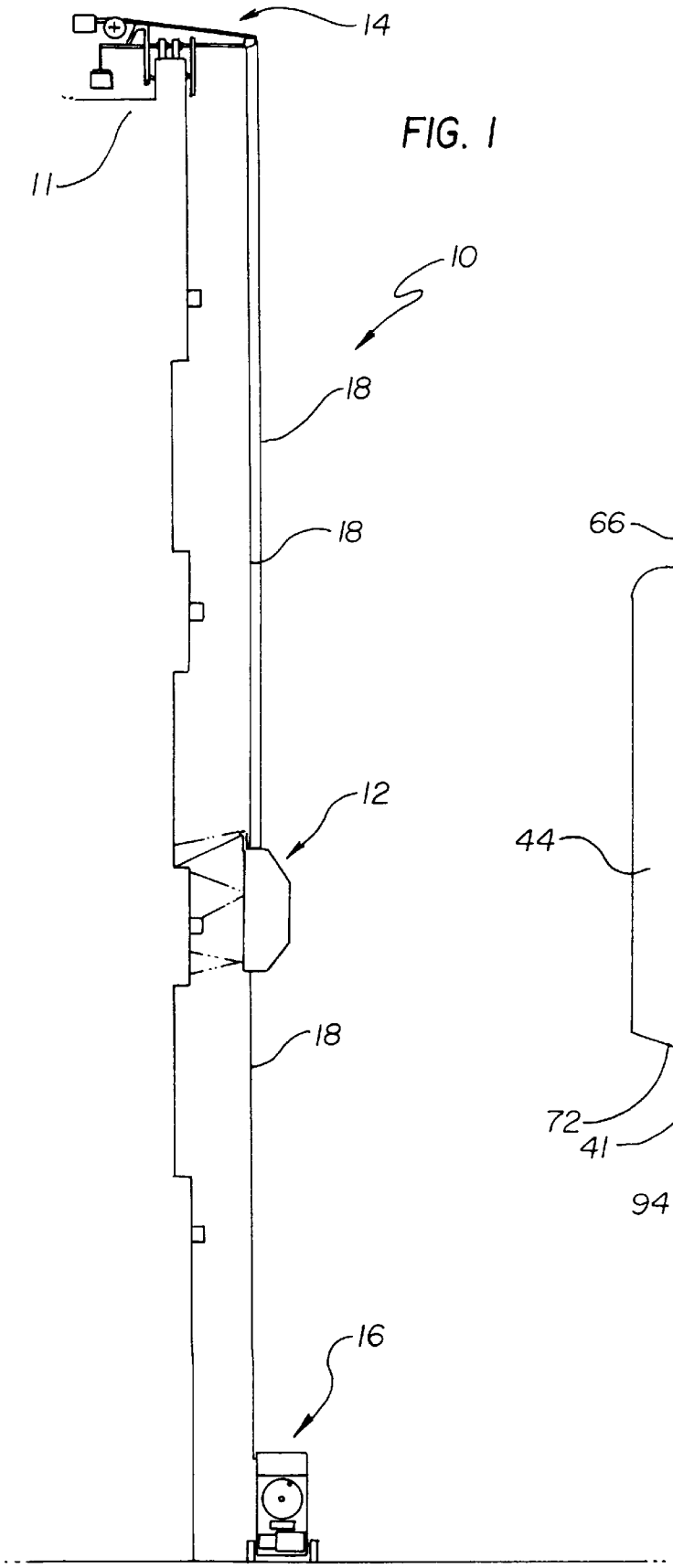
FIG. 1
FIG. 1a
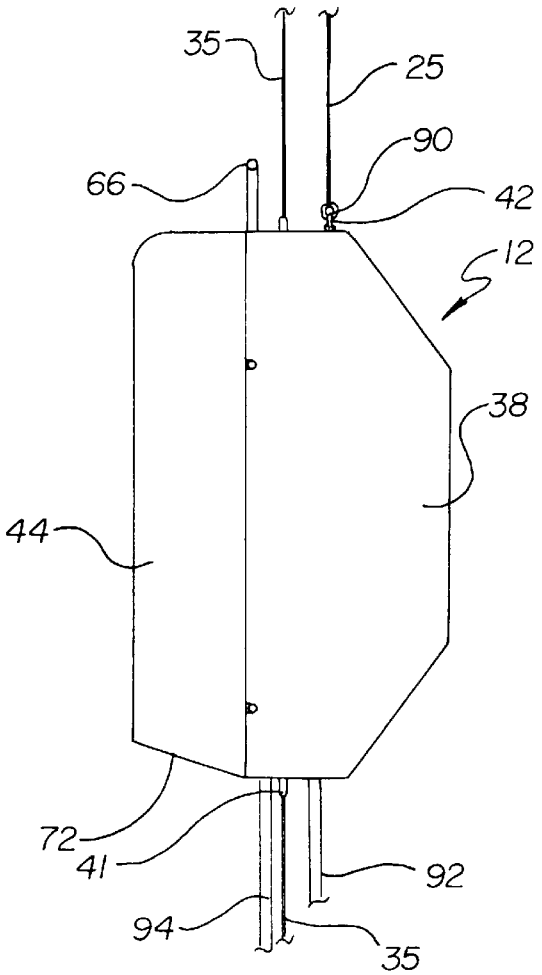

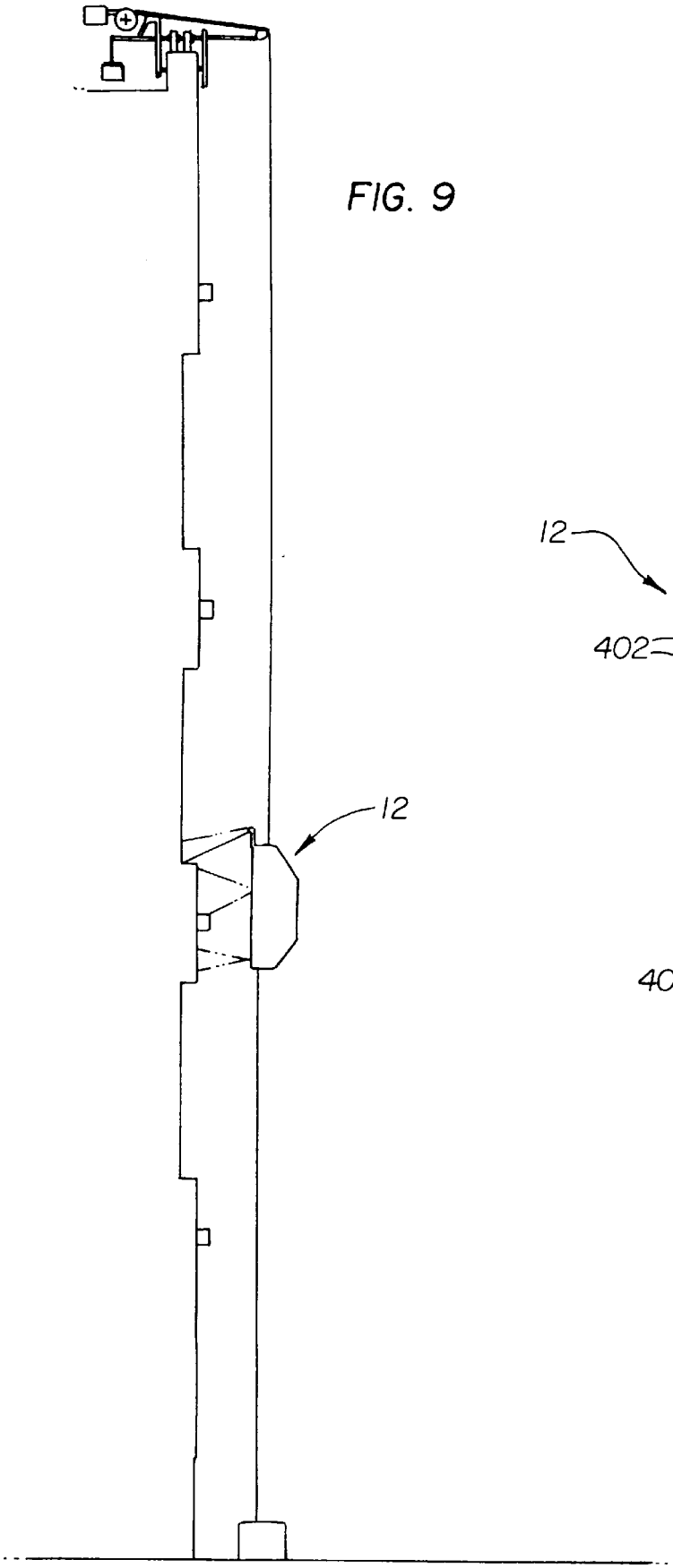
FIG. 9
FIG. 9a
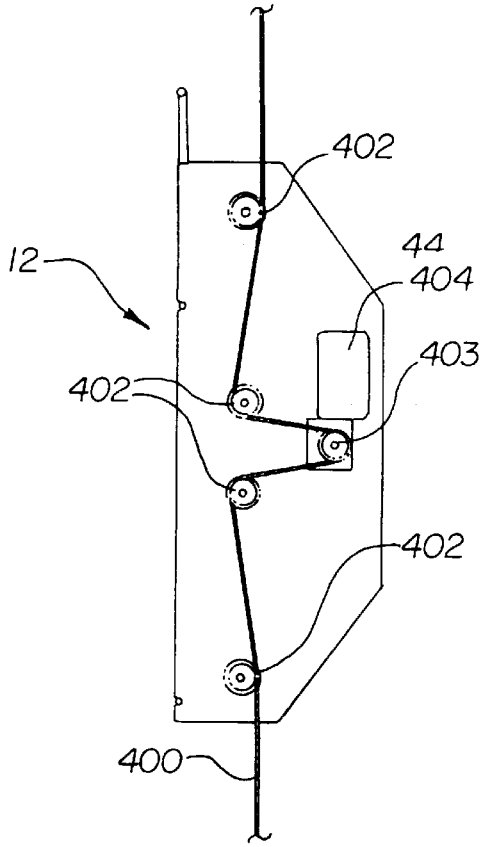

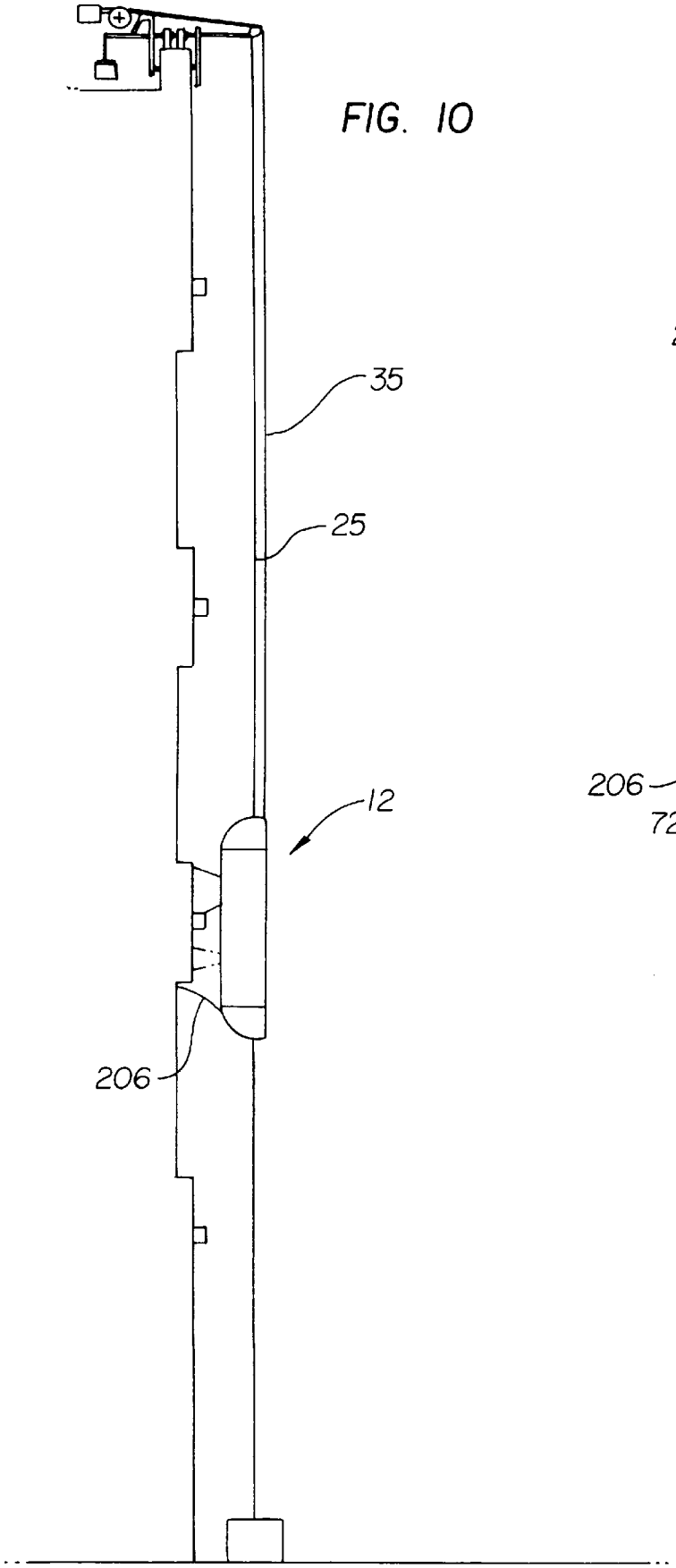
FIG. 10
FIG. 11
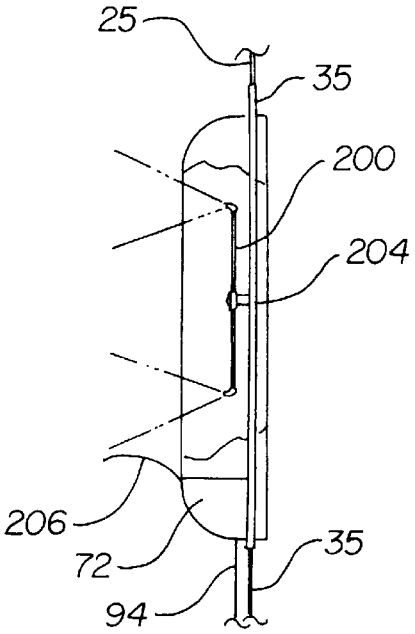

APPARATUS FOR APPLYING FLUIDS TO VERTICAL SURFACES NONMANUALLY AND PERFORMING OTHER NONMANUAL TASKS ADJACENT VERTICAL SURFACES

This application is based on copending provisional application Ser. No. 60/032,706 filed Dec. 12, 1996, which is based on copending provisional application Ser. No. 60/024,914 filed Aug. 30, 1996.

SUMMARY OF THE INVENTION

The present invention relates to an apparatus for performing nonmanual tasks on and adjacent vertical surfaces. More specifically the present invention relates to an apparatus for applying fluids to vertical surfaces nonmanually. Even more specifically, the present invention relates to a washing apparatus.

The washing apparatus of the present invention washes vertical surfaces and substantially vertical surfaces such as buildings, walls and tanks, and is designed to clean irregular surfaces, which may include obstacles such as window frames and building ledges. The washing apparatus also is designed to clean regular and irregular surfaces without being attached to the surface being cleaned and without contacting the surface being cleaned with brushes, squeegees, vacuum systems, and/or high pressure air.

More specifically, the washing apparatus of the present invention includes a top control unit, a spraying unit, a bottom control unit and various flexible elongated members, such as cables, ropes or chains connecting the spraying unit, the top control unit, and the bottom control unit to each other and at least one hose connecting the spraying unit to the bottom control unit.

The spraying unit includes a housing having at least one hose attachment fitting and connection elements for the flexible elongated members, and at least one fluid spray bar or tube having at least two fluid spray nozzles.

The top control unit includes a carriage which is rollably positioned on the top of the structure being cleaned adjacent the structures outside edge. The carriage includes a power winch and at least one hand winch.

The bottom control unit includes a frame, a motor, a pump, at least one hose, a fluid tank, a control panel, and an attachment element for the flexible elongated members.

In various embodiments, the flexible elongated members include one or more guide cables and a lift cable. The lift cable attaches the spraying unit to the power winch. The one or more guide cables are attached to the top control unit and the bottom control unit and the spraying unit is slidably connected to the one or more guide cables. The at least one hose includes a fluid supply hose which is connected to the fluid tank and to the at least one hose attachment fitting.

In operation, the spraying unit of the present invention is connected to the guide cables and the lift cable and suspended along the side of a structure. The user then places the bottom control unit a certain distance from the side of the structure to be cleaned and uses the at least one hand winch to tighten the one or more guide cables so that the one or more cables are under sufficient tension to keep the spraying unit approximately the same distance from structure as the bottom unit. The spraying unit is then pulled up to the top of the surfaced to be cleaned by activating the power winch.

The user activates the motor of the bottom control unit which forces fluid up to the spraying unit through the fluid supply hose. The motor can be activated before the spraying unit is pulled upward, or it can be activated before it is lowered downward as described below. The fluid is forced through all the sets of nozzles on the at least one fluid spray bar. Before entering the at least one fluid spray bar, the fluid may be intermixed with cleaning solution from a cleaning fluid dispenser. The nozzles on the at least one spray bar or tube are selected to maximize the objective of the fluid being used.

When more than one fluid spray tube is used, one spray tube can be used to apply a cleaning fluid to the surface being cleaned, and another spray tube can be used to apply a rinsing fluid. With respect to the cleaning fluid nozzles, the type of nozzle is selected to maximize the impact of the fluid on the cleaning surface. With respect to the rinse fluid nozzles, the nozzles are selected to maximize their coverage over the area covered with cleaning fluid.

The user then activates the power winch which unwinds the lift cable so that the spraying unit traverses the building in a downward direction at a controlled rate of speed. Upon reaching the bottom of the surface of the building being cleaned, the user terminates the flow of fluid to the spraying unit, moves the top control unit and bottom control unit over to the next section of the building to be cleaned and activates the power winch so that it retrieves the lift cable thereby lifting the spraying unit to the top of the building surface to be cleaned. (The water flow can be activated just prior to activating the power winch or after the spraying unit reaches the top of the building). The process discussed above is then repeated until the entire surface of the building being cleaned is cleaned to the user's satisfaction.

It is an object of the present invention to provide an apparatus for cleaning vertical surfaces with fluids that does not physically touch the surface of the building being cleaned with anything other than fluids.

It is a similar object of the present invention to provide an apparatus for cleaning vertical surfaces with fluids that cleans the entire building's vertical surfaces.

It is another object of the present invention to provide an apparatus for cleaning vertical surfaces with fluids that cleans highly irregular surfaces.

It is still another object of the present invention to provide an apparatus for cleaning vertical surfaces with fluids that is light weight, and easily transported and operated by one person.

It is yet another object of the present invention to provide an apparatus for cleaning vertical surfaces with fluids that is inexpensive to manufacture and efficient to maintain and use.

It is a further object of the present invention to provide an apparatus and method for cleaning vertical surfaces with fluids that cleans efficiently without using brushes, squeegees, vacuum systems, and/or air blowers.

Other objects and advantages of the present invention will become more fully apparent and understood with reference to the following specification and to the appended drawings.

BRIEF DESCRIPTION OF THE DRAWINGS

FIG. 1 is a side view of a washing apparatus of the present invention cleaning the side of a building showing the spraying unit attached to the top control unit and bottom control unit.

FIG. 1*a* is a side view of a spraying unit of the present invention with a splash guard and trough attached to its housing.

FIG. 9 is a side view of a washing apparatus of an alternative embodiment incorporating improvements of the present invention that has a chain and sprocket assembly instead of a lift cable and guide cables.

FIG. 9*a* is a side view of a spraying unit of the alternative embodiment depicted in FIG. 9 with a side cover removed to show the chain and sprocket assembly.

FIG. 10 is side view of a washing apparatus of another alternative embodiment incorporating improvements of the present invention.

FIG. 11 is a side view of the spraying unit of the alternative embodiment depicted in FIG. 10 with the housing broken away to show the single spray bar attached to a swivel.

DETAILED DESCRIPTION OF THE INVENTION

Figure 2:
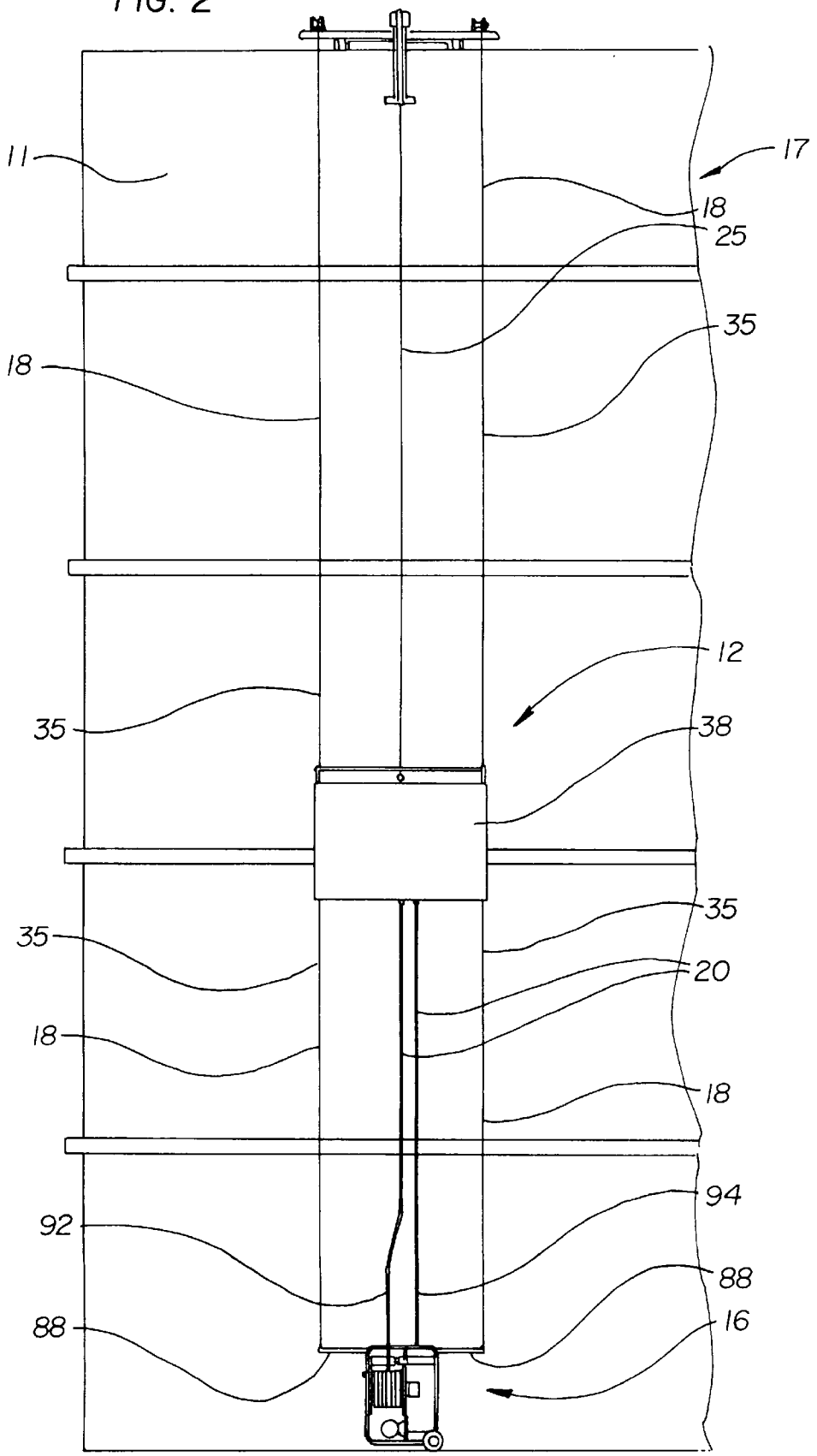
FIG. 2 is a front view of a washing apparatus of the present invention cleaning the side of a building showing the spraying unit attached to the top control unit and bottom control unit.
Figure 3:
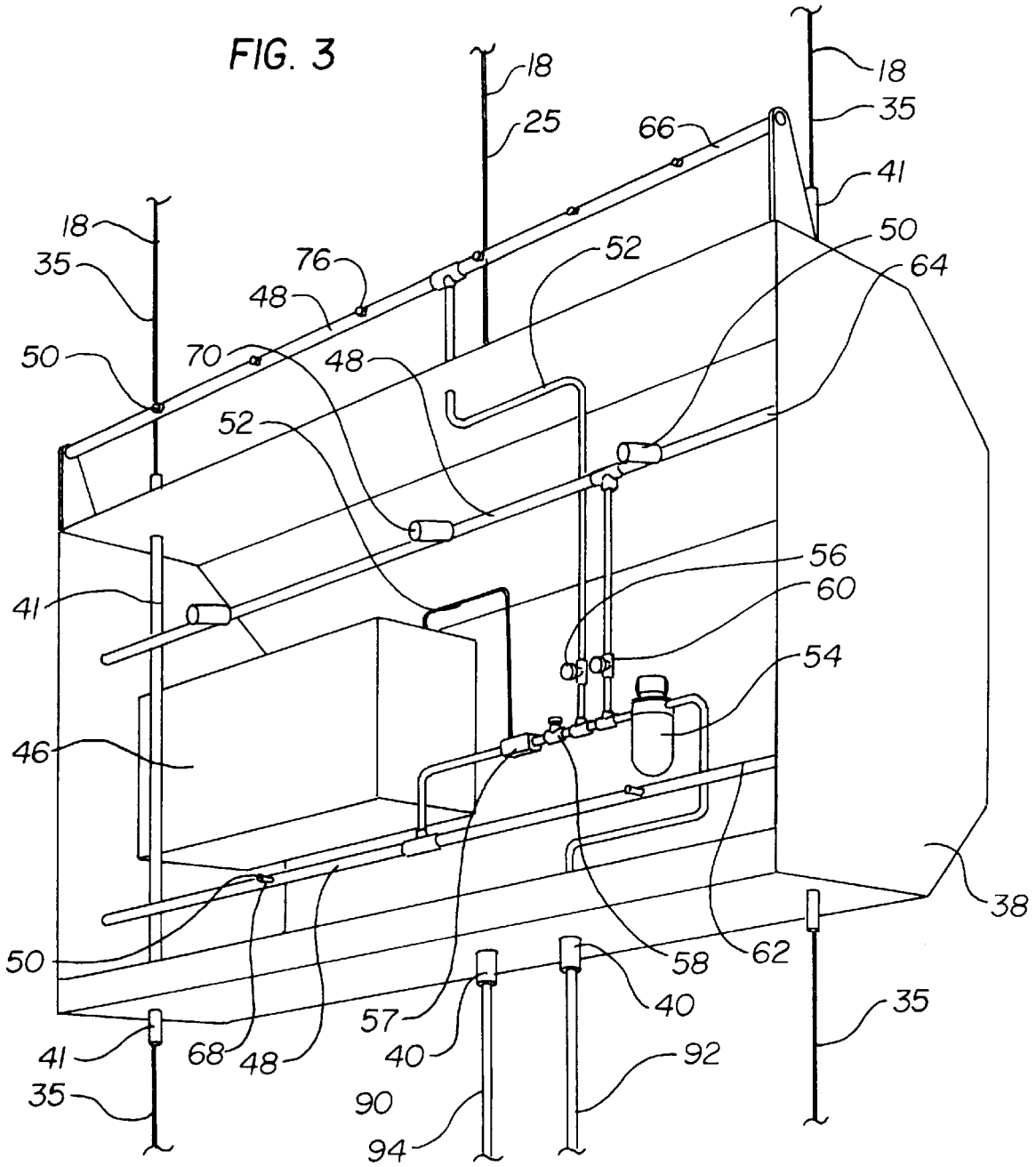
FIG. 3 is an isometric view of the underside or back of a spraying unit of a washing apparatus incorporating improvements of the present invention.
Figure 4:
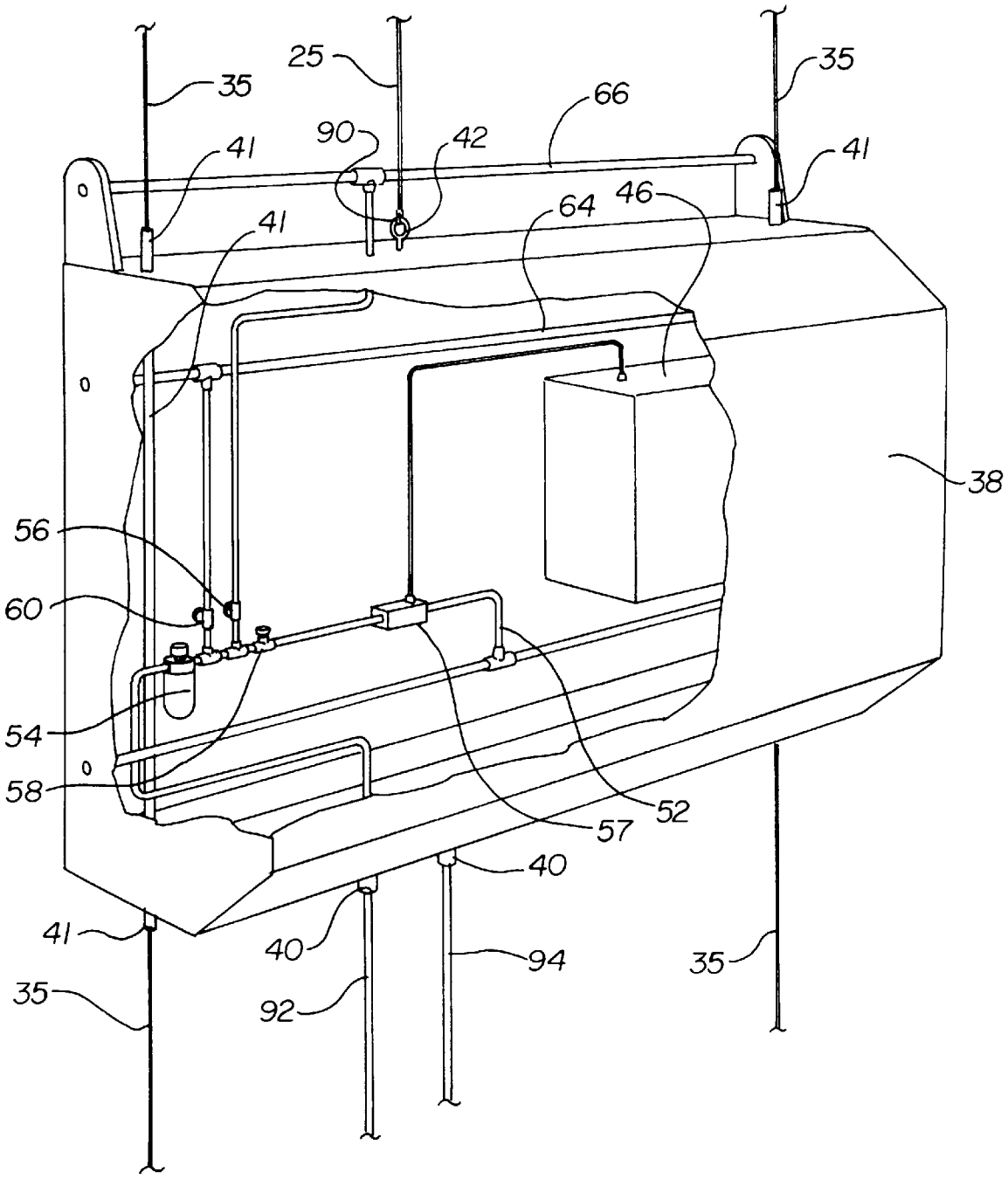
FIG. 4 is an isometric view of a spraying unit of a washing apparatus incorporating improvements of the present invention with a portion of the housing broken away.

Reference is first made to FIGS. 1 and 2 showing one embodiment of a washing apparatus 10 of the present invention cleaning the side of a building 11. The washing apparatus broadly includes a spraying unit 12, a top control unit 14, a bottom control unit 16 and various cables 18 connecting the spraying unit 12, the top control unit 14, and the bottom control unit 16 to each other, and hoses 20 connecting the spraying unit 12 to the bottom control unit 16 and extending to the ground. The spraying unit 12 is suspended from the top control unit 14 which is rollably mounted to the top of the building to be cleaned. The top control unit 14 is rollably positioned at an edge of the building 11 so that once the spraying unit 12 cleans one vertical section of the building surface, the top control unit 14 and bottom control unit 16 can be moved to the next vertical section of the building 11 to be cleaned. The washing apparatus 10 typically cleans in a top to bottom direction, but it can be used to apply a presoak fluid in a bottom to top direction, or it can be used to clean in certain situations in both directions. It also should be understood that because the top control unit is easy to roll and the guide cables 35 can be "anchored" to a rollable cart or weight, the washing apparatus 10 of the present invention could be used to clean certain structures in a side to side direction instead of, or in addition to, a top to bottom or bottom to top direction.

Figure 6:
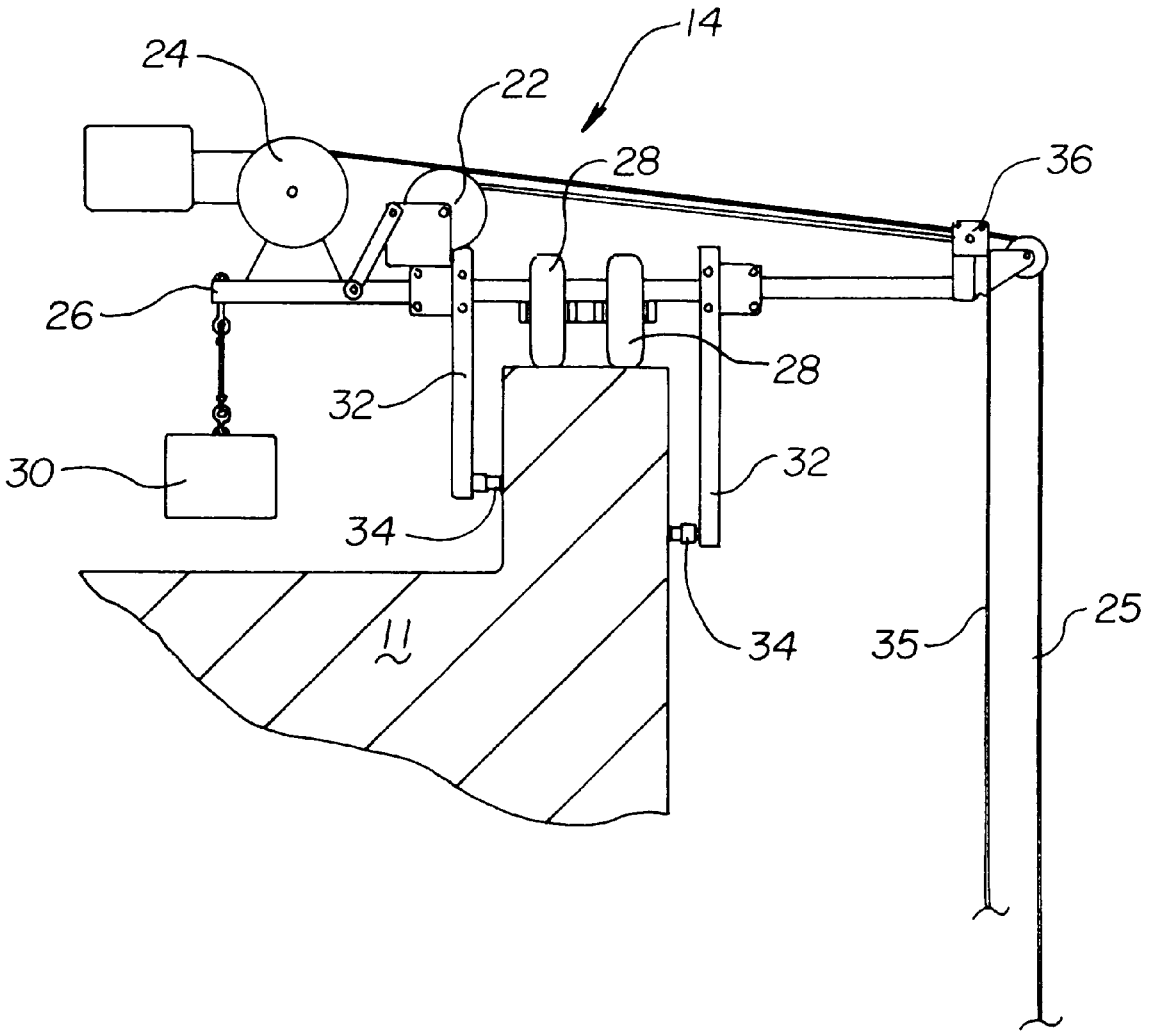
FIG. 6 is a side view of a top control unit of a washing apparatus incorporating improvements of the present invention.
Figure 7:
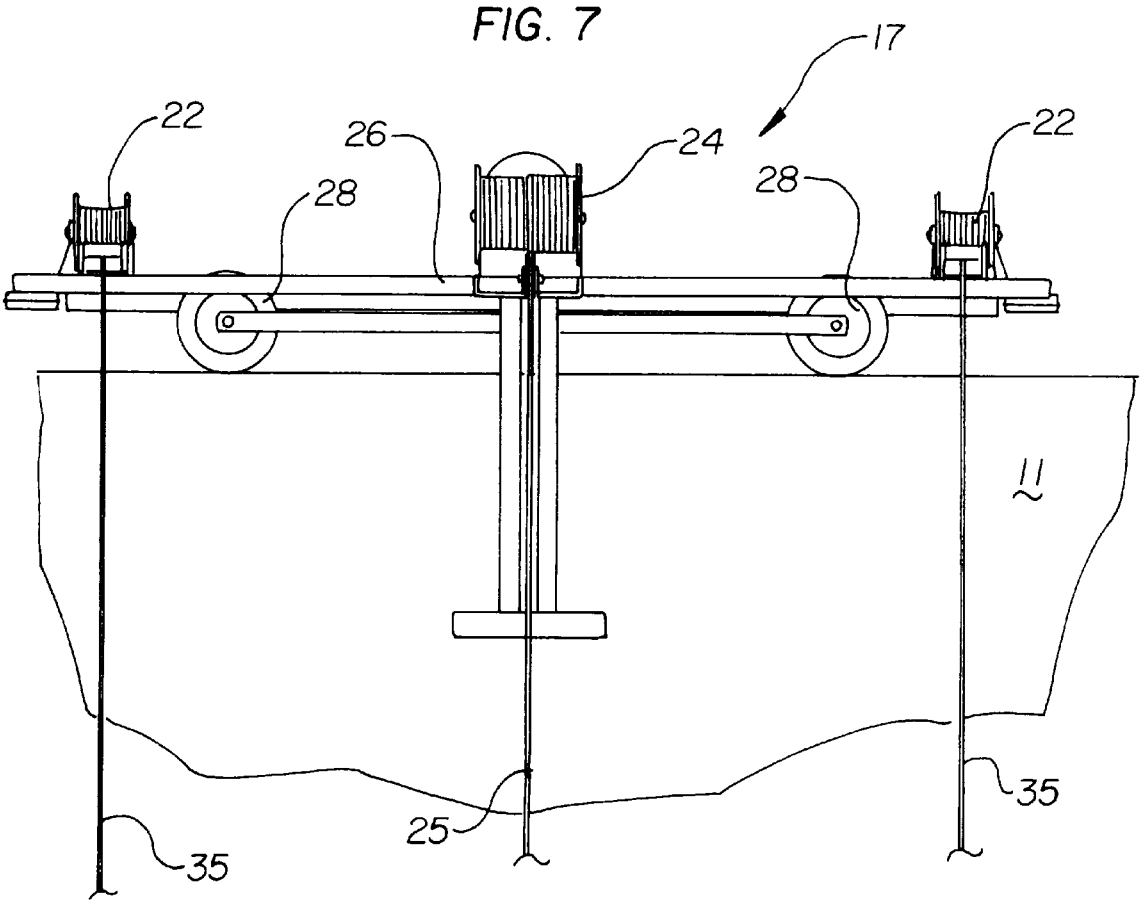
FIG. 7 is a front view of the top control unit of a washing apparatus incorporating improvements of the present invention.

Referring to FIGS. 6 and 7, the top control unit 14 includes two hand winches 22 and a 110 volt power winch 24 mounted to a parapet wall roller 26. The power winch 24 is a drum type which can hold approximately 1000 feet of ⅛ inch lift cable 25 having a breaking strength of 2000 pounds. The power winch 24 is commercially available through Cordem Corporation in Minnetonka, Minn., and is identified as Model No. 7-155MA. Another type of winch that can be used as a power winch is the XL264 winch available from Global Trading, Coral Gables, Fla. The XL264 winch mounts quickly to the top control unit and can reel from zero feet to 240 feet of cable in one minute. The motor can operate on 12 volts (if electricity is not available) or can be converted to AC110 volts. The motor operates in forward and reverse with the use of a clutch. The XL264 winch includes an interchangeable spool that can hold hundreds of feet of line. A cable spooler controls the cable keeping it straight and uniform on the spool, and a counter displays how much cable is out at all times. The motor is intended for operation in adverse weather and is saltwater resistant. The XL264 also provides an option to operate the winch manually if needed. Also, it can be used as a weight on the back of the top control unit 14 to eliminate the need to add additional weight. Still another type of winch that can be used as a power winch is the RMO1215 model number Cordem Winch also sold by Cordem Corporation of Minnetonka, Minn. The Cordem Winch holds about 1000 feet of cable, is 110 volts and has a continuous duty cycle with a low voltage control unit attached to the winch.[1]/The winch will automatically reverse when the spraying unit 12 comes in close contact with a proximity sensor (which is a separate unit that is commercially available). (One such proximity sensor is the Turck proximity sensor, part number BI5S18AZ3X, sold by Powermation, St. Paul, Minn.). The proximity sensor can be connected to the low voltage control unit. The proximity sensor is adjustable and has approximately 20 feet of cable which can be positioned along side the lift cable 25. An object that will be sensed by the proximity sensor can be adjustably positioned above the end of the lift cable (which will be discussed below) to cause the Cordem winch to reverse directions. This feature eliminates the necessity of an operator having to constantly watch the spraying unit 12 for when it comes close to the top or roof of the structure being cleaned. There also is an option for overriding the sensor at any time during operation, and the low voltage control unit can be used with a remote control. The Cordem winch includes an AC current sensor that monitors for any over currents. The current sensor operates as an automatic shut-off for the motor if the spraying unit 12 were to get entangled during operation.

[1]/A Variac® can be connected to the electrical power line that feeds the winch to reduce the electrical voltage and thereby slowing the winch's drum speed.

Figure 18A:
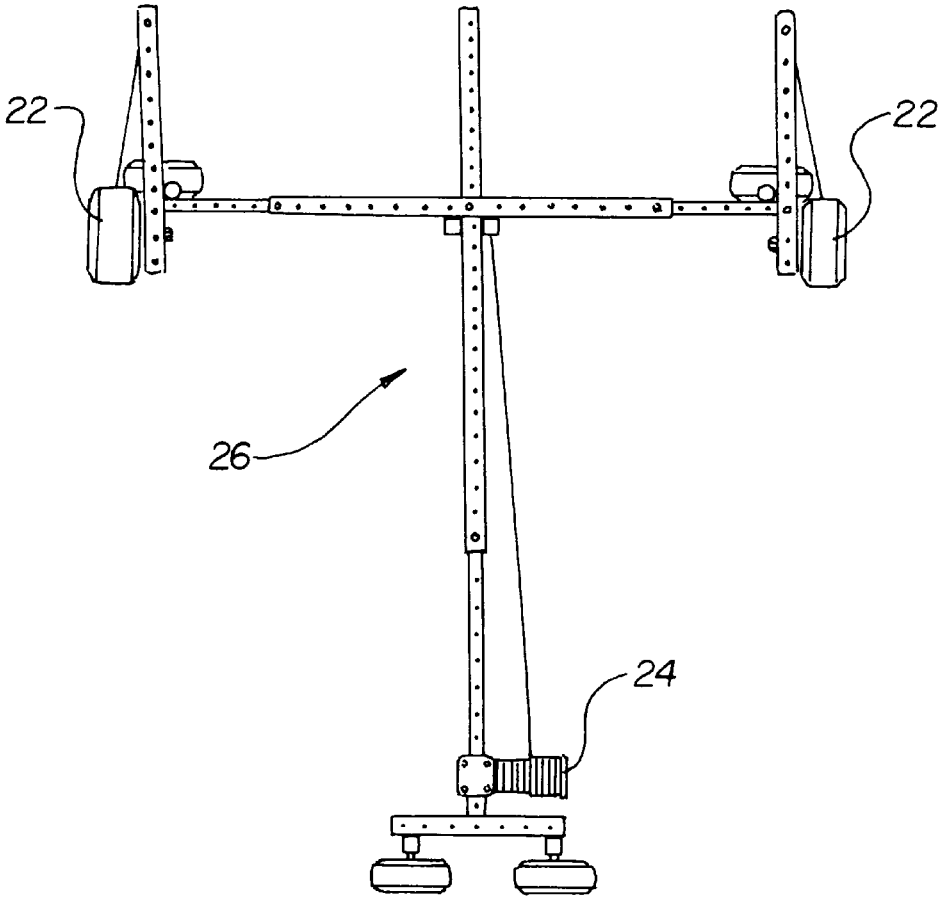
FIG. 18*a* is a top plan view a top control unit that can be used on buildings having no wall on its roof.
Figure 18B:
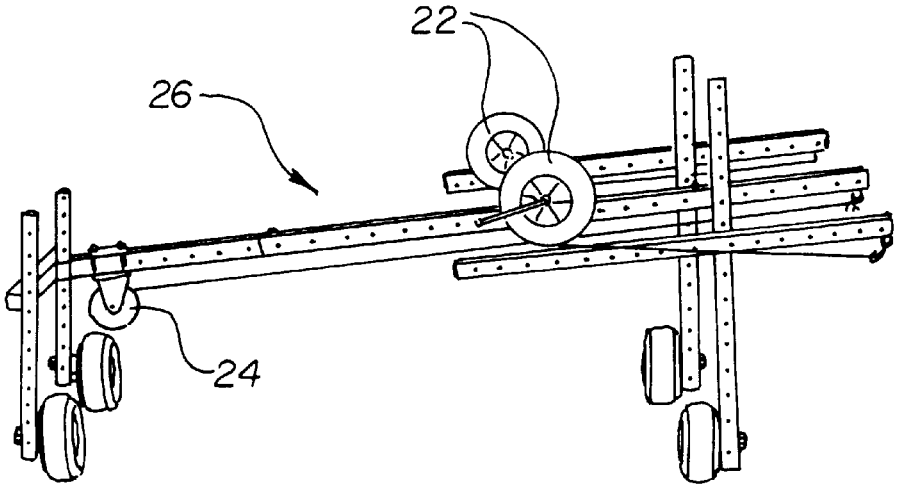
FIG. 18*b* is an isometric view a top control unit that can be used on buildings having no wall on its roof.

The parapet wall roller 26 has four air tires 28 that contact the top of the building wall being cleaned, so the washing apparatus 10 can be easily rolled to the next cleaning area. A weight 30 attached to the back of the parapet wall roller, and two stabilizing arms 32 with rubber wheels 34 that adjust to the wall thickness by clamping tight to the wall, balance the parapet wall roller 26 on the building 11. The parapet wall roller 26 is based on a parapet wall roller commercially available through Fitch Enterprises of Council Bluffs, Iowa. It should be understood that the wall roller 26 depicted in FIGS. 6 and 7 is for use on buildings having a "walled" top, and that other rollers are commercially available for use on flat roofs or surfaces and that these rollers can be similarly modified for use with the present invention. FIGS. 18*a* and 18*b* depict one such roller that can be adjusted to be used on "flat" roofs or walled roofs.

The two hand winches 22 each typically have 500–1000 pound capacities, but for some applications hand winches 22 with significantly less capacity could be used. The hand winches 22 are commercially available through Dutton Lainson Co. in Hastings, Nebr. and are identified by part number DL600. Also, fishing reels such as Model Nos. XL11 and XL25 sold by Global Trading and Ventures, Inc., of Coral Gable, Fla., can be used as hand winches. The hand winches 22 each have a guide cable 35 that follows through a four-way roller fairlead 36 that keeps the guide cable 35 in place for high or low friction pulling. The four-way roller fairlead 36 is commercially available through Superwinch of Putnam, Conn. Each hand winch 22 can hold 300 feet to 1,000 feet of guide cable 35.

Referring to FIGS. 1*a,* 3 and 4, one embodiment of the spraying unit 12 includes a housing or shroud 38 having two hose attachment fittings 40, two guide tubes 41 and a cable attachment point 42, splash guards 44, a trough 72, a cleaning fluid dispenser 46, and three spray bars 48 each having multiple fluid spray nozzles 50 interconnected with tubing 52, a high pressure regulator 54, deionized water flow control valve 56, soap flow control valve 58, high pressure flow control valve 60 and a siphon unit 57. The control valves are all commercially available through Spray Systems Co., of Wheaton, Ill.

The spray bars 48 consist of a soapy water spray bar 62, a rinse water spray bar 64, and a final rinse water spray bar 66. It should be understood that only one water supply line is connected to the spraying unit. In the preferred embodiment the water supplied is deionized or purified water.

The soapy water spray bar 62 is low pressure (40–250 PSI) which is reduced from high pressure to low pressure by the control valve 58. The nozzles 50 the soapy water spray bar 62 are oscillating spray nozzles 68 and create a spray pattern as depicted by Arrow A in FIG. 5. It should be understood that the oscillating spray pattern covers the entire surface of the structure being cleaned along the length of the soapy water spray bar 62. The siphon unit 57 and the soap flow control valve 58 regulates the flow of the soap that enters the soapy water bar 62, which sprays a consistent amount of soap on the surface through oscillating spray nozzles 68 to emulsify the dirt on the surface.

The rinse water spray bar 64 has pulsating nozzles 70. The water from the activated pulsating nozzles 70 is high pressure (approximately 250–2500 PSI per nozzle) and moves in a circular motion as depicted by Arrow B in FIG. 5. Although the embodiment depicted in FIGS. 1–9 includes a control valve 60 between the high pressure regulator 54 and the rinse water spray bar 64, this valve is typically left open to force water under full high pressure water through the activated pulsating nozzles 70. It should be understood that the valve can be adjusted to decrease the pressure depending on the type of structure being cleaned. The impact of the high pressure pulsating water breaks down any dirt left on the surface after the application of the soapy water. Gravity, the circulating motion, and the high impact of the water with the nozzles at a slightly downward direction create a water-like squeegee effect that moves the water, dirt and soap down the building. On the bottom of the spraying unit 12 is a trough 72 that collects water that has bounced off the building surface, splash guards 44, and the housing 38. This water flows to a drain hose 94, then runs down to the ground.

Figure 5:
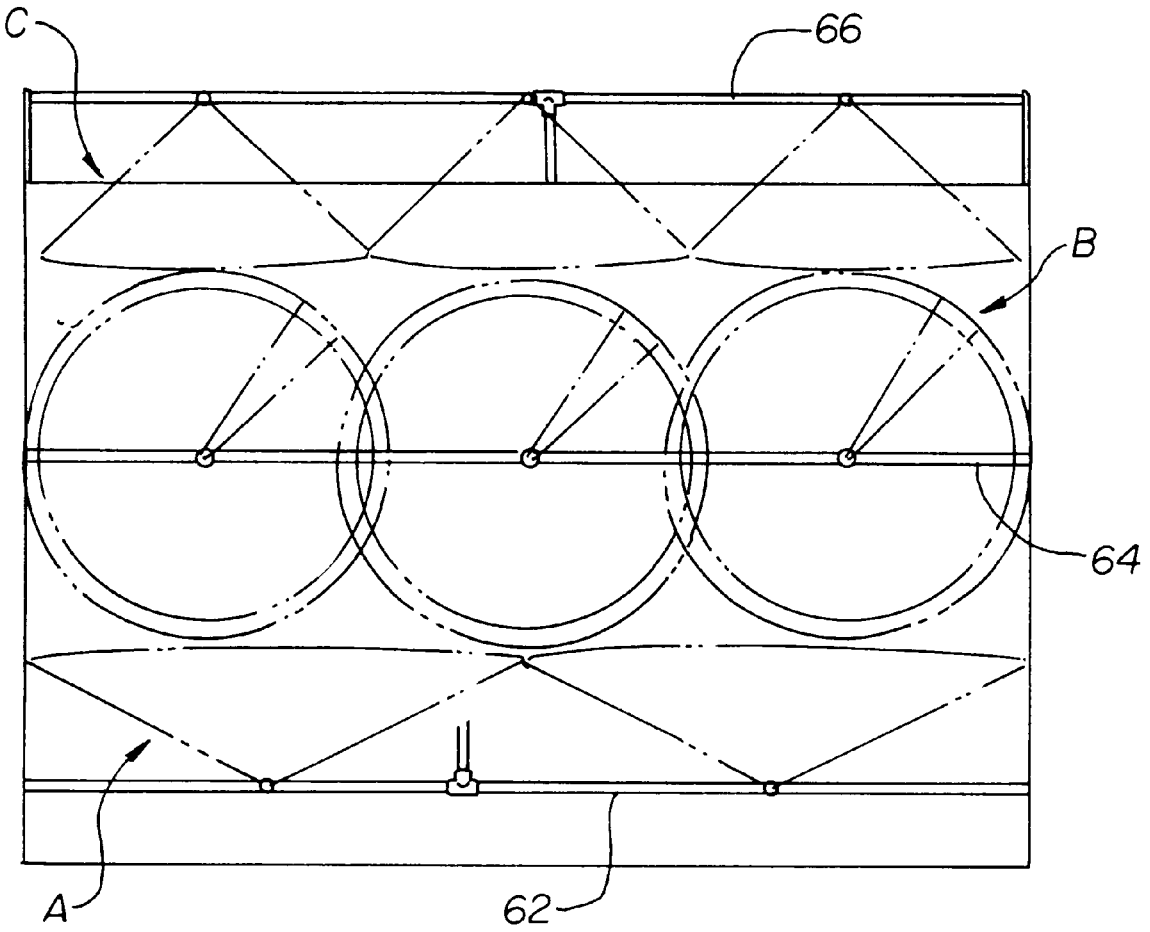
FIG. 5 is a diagram of water spray patterns provided by the spray nozzles of a spraying unit of a washing apparatus incorporating improvements of the present invention.

The final rinse water spray bar 66 has adjustable fan type spray nozzles 76 that create a spray pattern as depicted by Arrow C in FIG. 5 and can be adjusted from 0 degrees to 80 degrees. At low pressure (40–250 PSI) the fan type nozzles 76 overlap each other washing away any remaining dirt and soap down the building. This final application of deionized or purified water dries spot free.

The present invention as depicted in FIGS. 1–9 could be modified, so that only two spray bars are used, whereby the rinse water being deionized water is generously applied by slowing the speed of descent of the spraying unit 12, thereby eliminating the need for a separate application of a finishing deionized or purified water spray.

Figure 14:
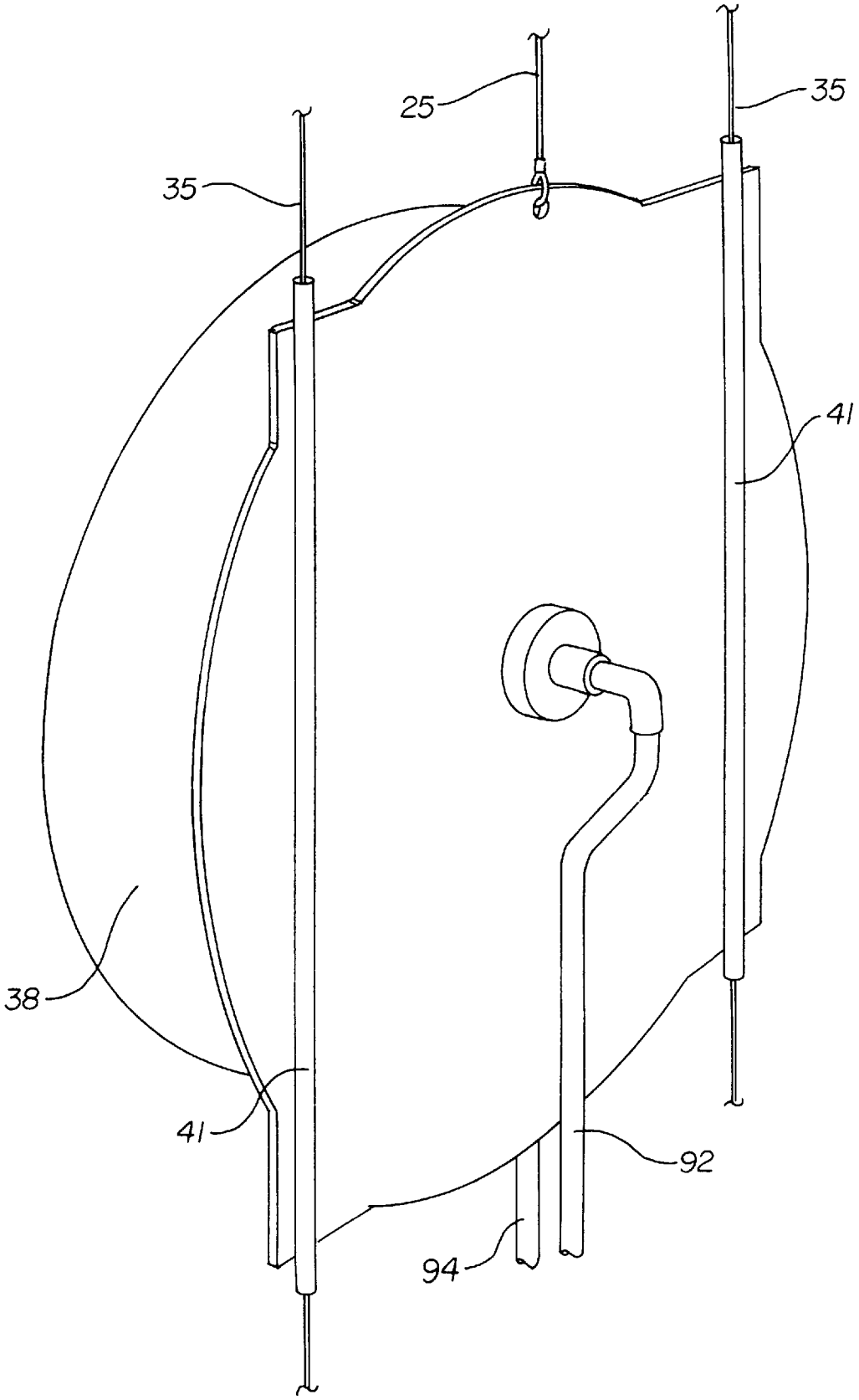
FIG. 14 is an isometric view of the housing of the spraying unit of the embodiment depicted in FIG. 10.
Figure 15:
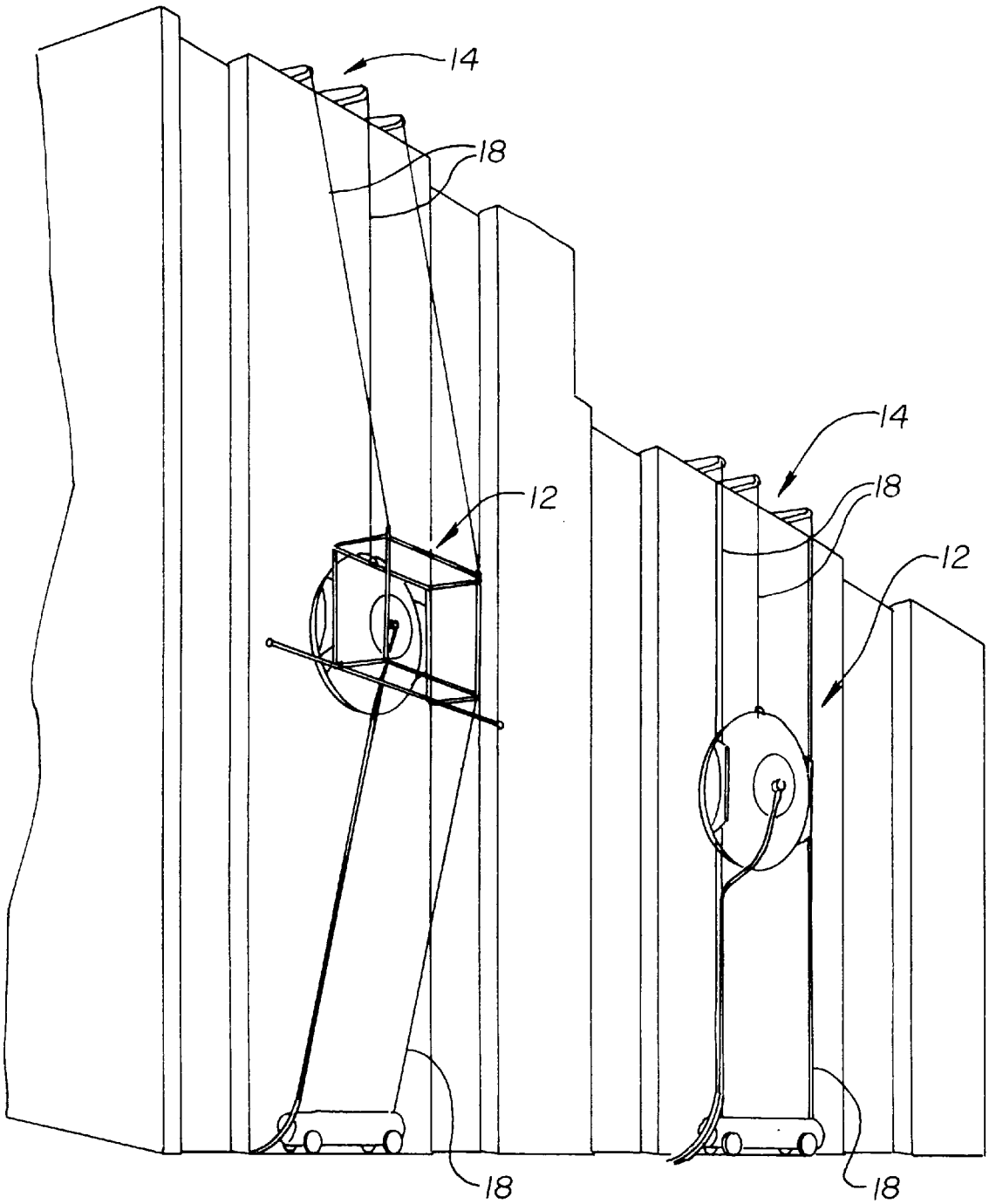
FIG. 15 is a side view of two washing apparatus of still another embodiment of the present invention cleaning the side of a building showing each spraying unit attached to a top control unit and a bottom control unit, and showing the guide cable posts extension member and stabilizer bar mounted on the apparatus which is cleaning the taller section of the building.
Figure 16:
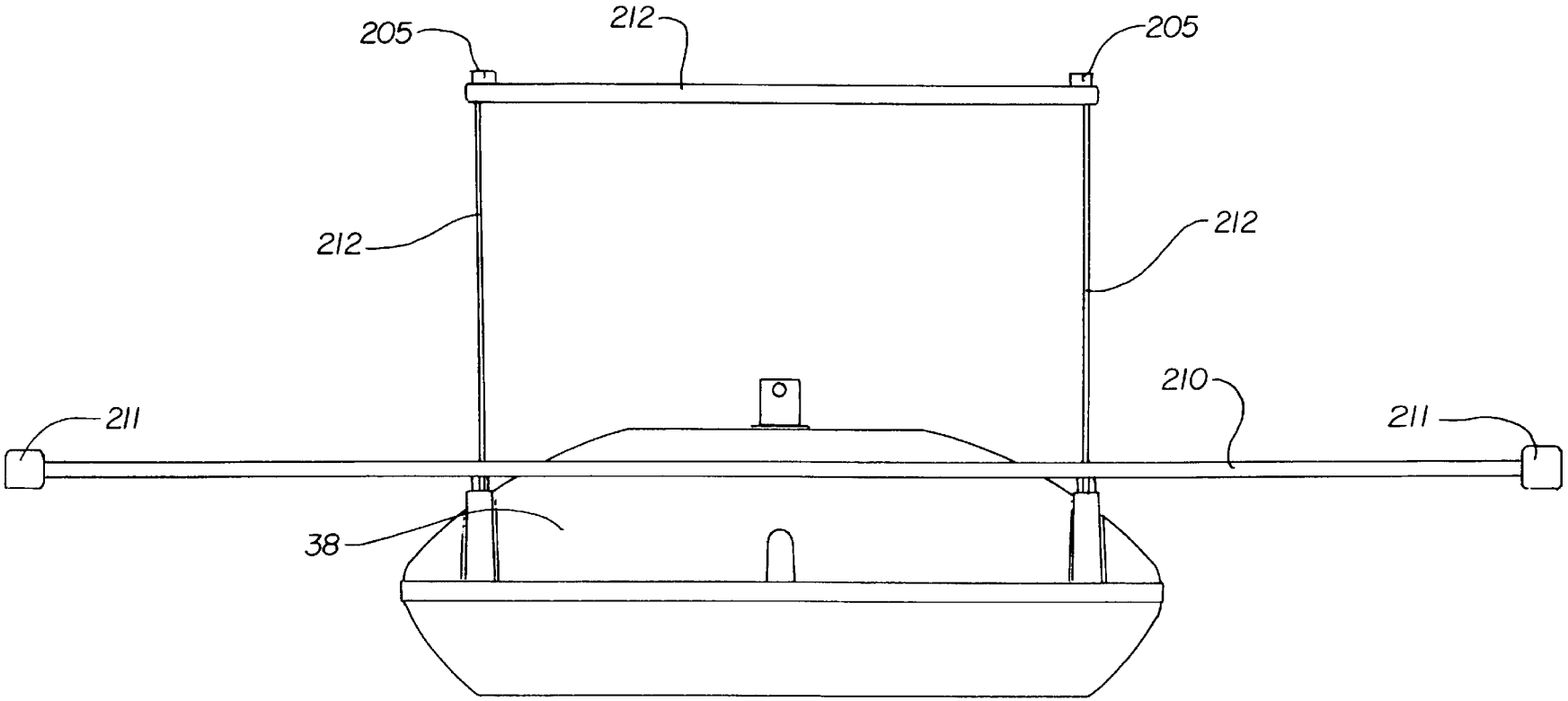
FIG. 16 is a plan view of a spraying unit of the alternative embodiment depicted in FIG. 15 with the guide cable posts extension member and stabilizer bar mounted on its housing.
Figure 17:
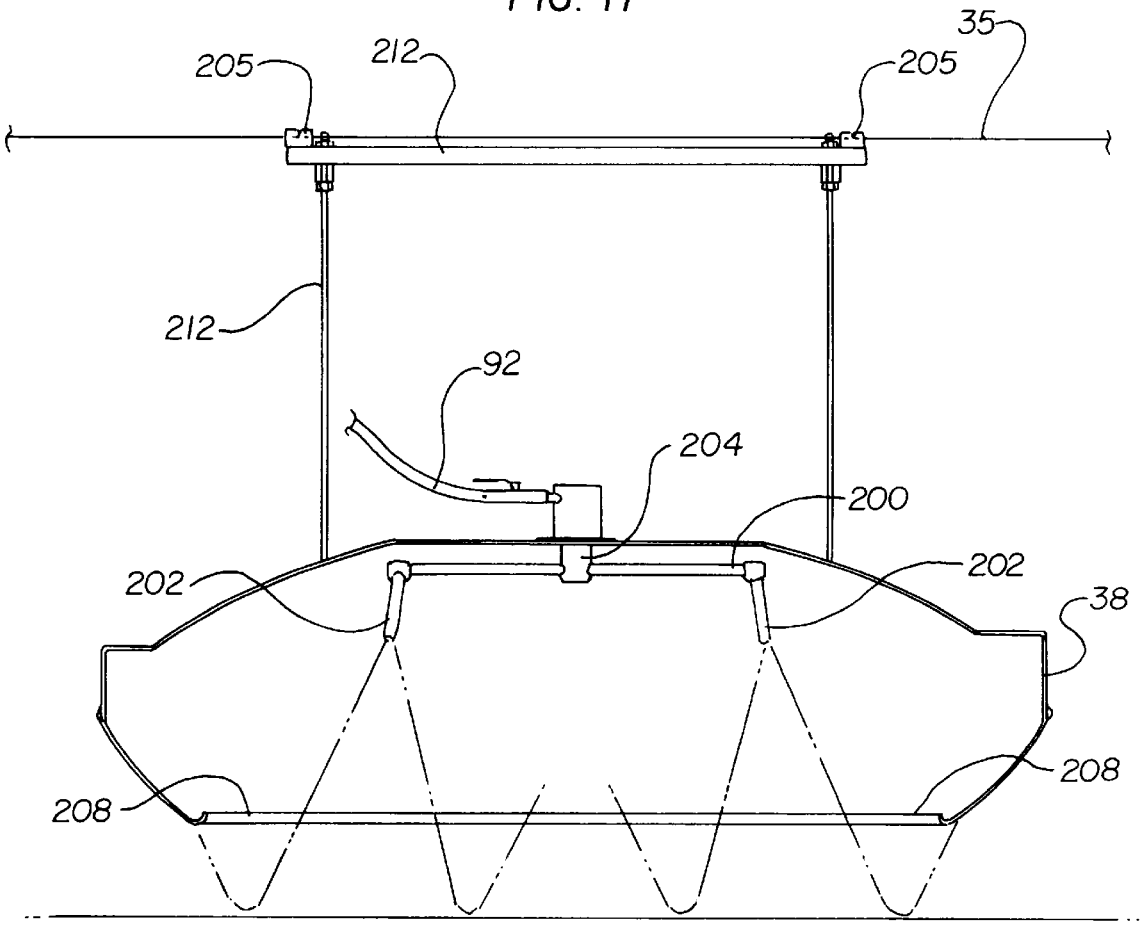
FIG. 17 is a cross-sectional view of a spraying unit of the alternative embodiment depicted in FIG. 15 with the guide cable posts extension member mounted on its housing, showing its spray bar and nozzles with fluid being sprayed out of the nozzles.

An alternative embodiment of the spraying unit 12 is shown in FIGS. 10–17. FIGS. 10–14 depict one variation of this alternative embodiment of the spraying unit 12 and FIGS. 15–17 depict another variation of this alternative embodiment of the spraying unit 12. As seen in FIGS. 11, 14, and 17, the spraying unit 12 of both variations of this alternative embodiment have only one spray bar 200 having two rotary spray nozzles 202, and the spray bar 200 is rotatably mounted at its center to a swivel 204 which is connected to the housing 38. The rotary spray nozzles 202 used in this embodiment are commercial available from Rhino Industries, Bloomington, Minn. under the tradename Rotomax. An advantage of this embodiment is that the single rotating spray bar 200 with rotary nozzles 202 eliminates the need for a pressure regulator, multiple spray tubes, and associated valves used with the embodiment depicted in FIGS. 1–9.[2]/

[2]/The elimination of multiple spray bars and nozzles significantly reduces the loss of pressure thereby eliminating the need for a pressure regulator.

The spray bar 200 is connected to the water supply hose 92 at a sealed fitting that is incorporated in the swivel 204. Each spray nozzle 202 is mounted on the end of the spray bar 200 at an angle relative to the surface to be cleaned so that the force of the cleaning fluid directed through the spray nozzles 202 to the surface to be cleaned cause the spray bar 200 to spin and thereby apply cleaning fluid uniformly to the entire area traversed by the spraying unit 12. The pitch of the nozzles 202 are selected to maximize the width of the spray pattern on the surface to be cleaned, to optimize cleaning ability of the spraying unit 12, and to cause the spray bar 200 to spin.

Figure 15A:
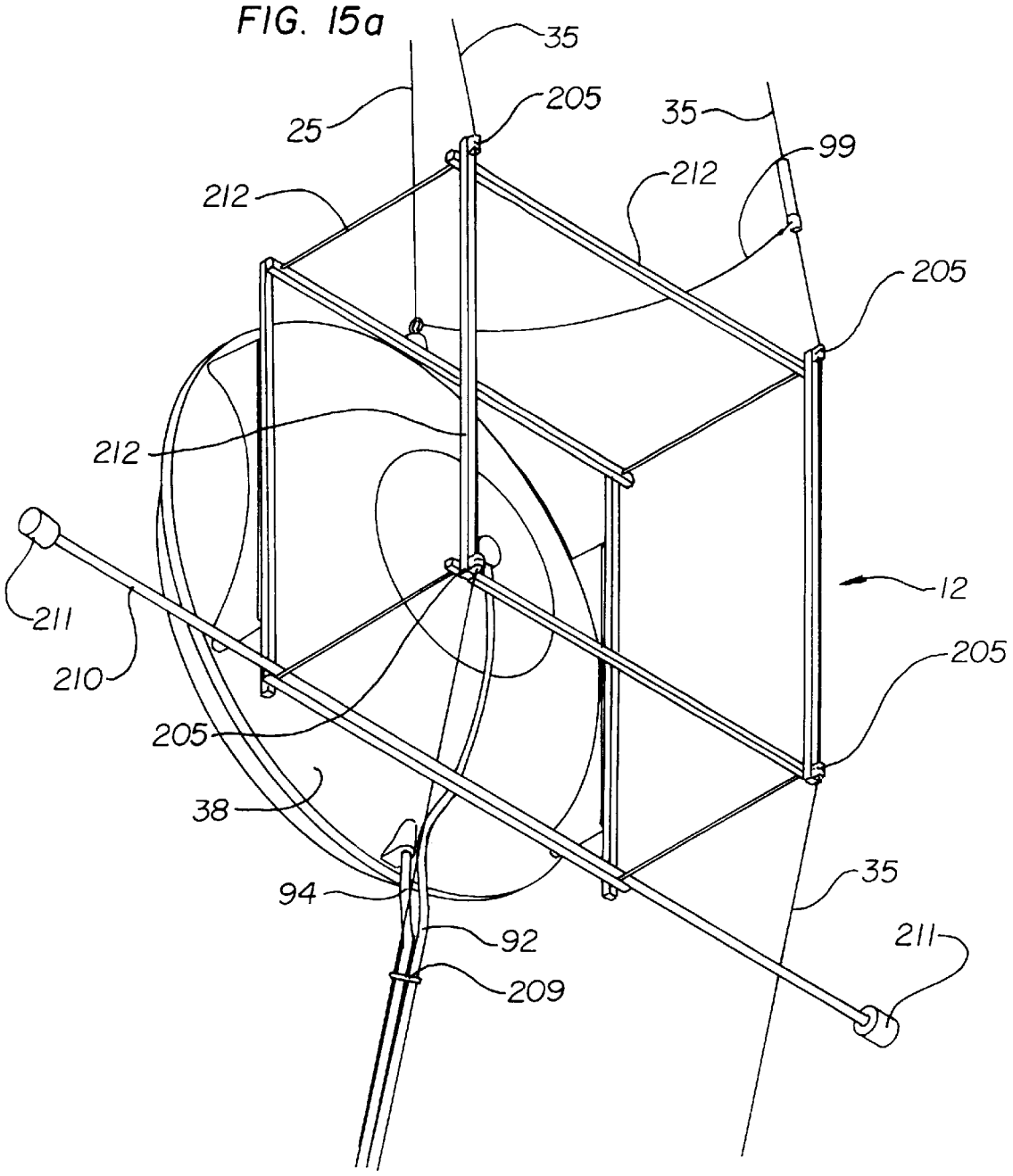
FIG. 15*a* is an isometric view of a spraying unit of the alternative embodiment depicted in FIG. 15 with the guide cable posts extension member and stabilizer bar mounted on its housing.
Figure 15B:
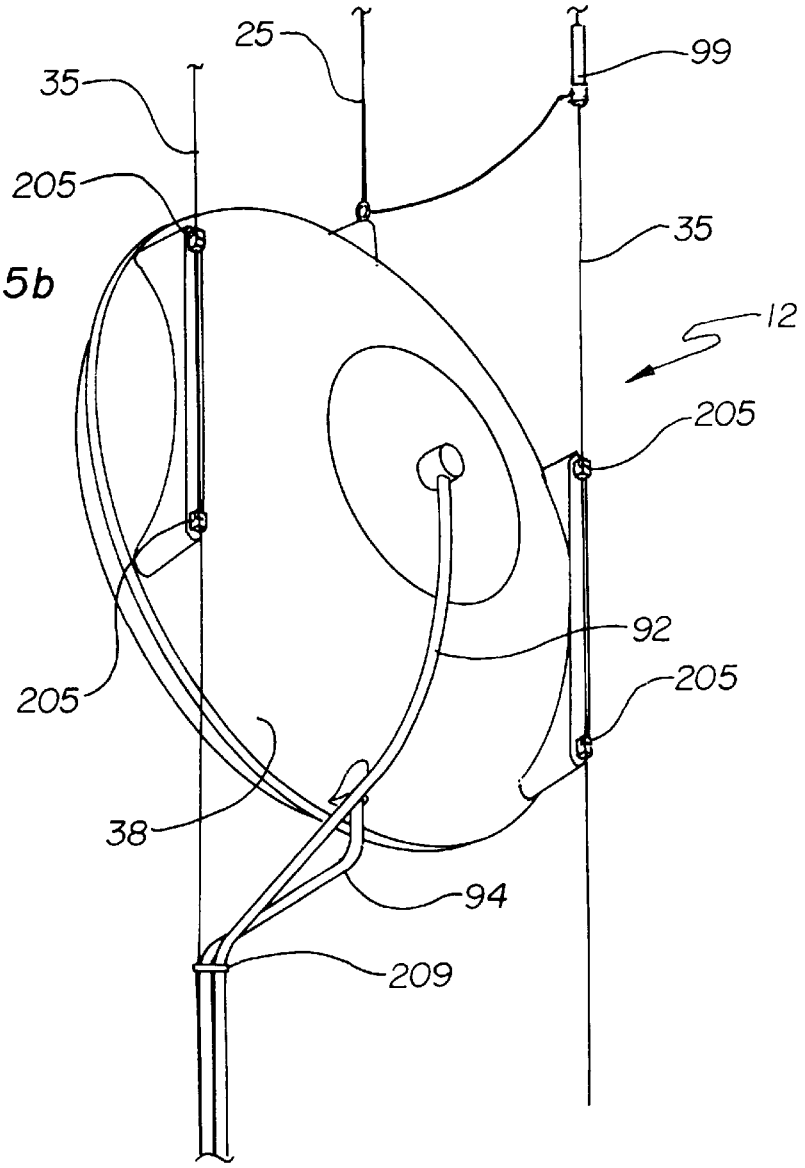
FIG. 15*b* is an isometric view of a spraying unit of the alternative embodiment depicted in FIG. 15 without the guide cable posts extension member and stabilizer bar mounted on its housing.
Figure 15C:
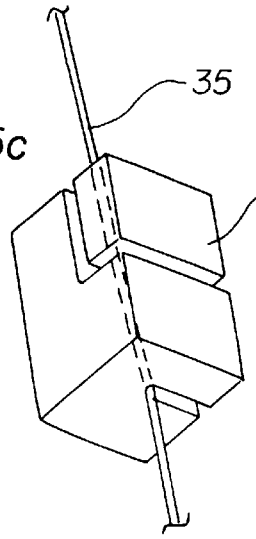
FIG. 15*c* is an isometric view of a guide cable post with a cable running through it.

The variation of the spraying unit 12 shown in FIGS. 10–14 includes guide tubes 41 through which the guide cables 35 pass. The variation shown in FIGS. 15–17, however, does not include guide tubes 41. Instead it the guide cables 35 are retained by, and are slidable connected to four guide cable posts 205, as shown in FIG. 15*b*. The cable posts 205 are preferably constructed materials such as Tivar 88, Mylar®, Kevlar®, Devlon®, stainless steel. The cable posts 205 are approximately one inch square, are mounted on the housing 38, and are designed so that the guide cables 35 can be quickly and easily attached to the spraying unit 12.

As seen in FIG. 11, this variation includes rubber fingers 206 that are mounted on the cleaning fluid collection trough 72 at an angle to direct the cleaning fluid into the trough 72 which drains to the ground through the drain hose 94. The rubber fingers 206 must be soft enough to prevent damaging scrapping or marring on the surface to be cleaned, but rigid enough to maximize collection of the cleaning fluid. As can be seen in FIGS. 16 and 17, this other variation of the alternative embodiment of the spraying unit 12 does not have rubber fingers 206. However, as seen in FIG. 17, this other variation of the spraying unit 12 has a circular trough formed by the inner edges 208 of the housing 38 that extend upward toward the spray bar 200. This variation also includes a drain hose 94 for draining the captured cleaning fluid to the ground.

Because increased fluid pressure increases the speed at which the spray bar 200 spins, increased fluid pressure results in increased cleaning speed. It is anticipated that the spraying unit 12 of the alternative embodiment depicted in FIGS. 10–17 can be lowered while cleaning at a rate of 0–240 feet per minute. The housings 38 are generally round in shape to accommodate the spray cleaning area resulting from the spinning spray bar 200.

It should be understood that the overall shape of the housing 38 can be modified to improve the stability of the spraying unit 12 without deviating from the spirit of the present invention. In particular, it has been found that the shape of the housing 38 depicted in FIGS. 15–17 enhances the stability of the spraying unit 12 in heavy wind and enables the spraying unit 12 to traverse ledge frames and other objects projecting outwardly from the surface being cleaned without getting entangled. The spraying unit's 12 stability in heavy winds can be further enhanced (regardless of the embodiment or variation) by the addition of the following: (1) small holes or screens in the housing that will allow air to pass through it, but which only permit fluid mist to escape; (2) a stabilizer bar 210 as shown in FIGS. 15–17; and (3) a quick clips 209 attached to a guide cable 35 (as shown if FIG. 15*a*), and the water supply hose 92 (discussed below). The stabilizer bar 210 has pads 211 that are made of rubber or a rubberlike substance. If the spraying unit 12 begins to twist because of the wind or other force, a stabilizer bar pad 211 will contact the surface being cleaned thereby preventing the spraying unit 12 from twisting further and keeping it in a cleaning relationship to the surface being cleaned. Preferably the bar 210 is telescoping so its length can be adjusted, and it is removably connected to the housing 38. When used, the clips 209 are preferably attached to the hose 92 and a guide cable 35 approximately every 50 feet. These clips 209 move with the spraying unit 12 as it moves up and down the building and reduces its tendency to twist in windy conditions.

It has been discovered that as the height of the building being cleaned increases, the wind has a greater effect on the stability of the spraying unit; primarily because of the distance between cable attachment points (the top control unit 14 and the bottom control unit 16). FIG. 15 depicts two spraying units 12 being used on a building having two sections of different heights. The spraying unit 12 being used on the higher section can be seen to include an adjustable guide cable extension member 212 consisting of multiple bars and rods which is removably mounted to the housing. As seen in FIG. 15*a,* the guide cable posts are mounted on the guide cable posts extension member 212. Because of the positioning of the top control unit 14 and bottom control unit 16, the guide cable posts extension member 212 causes the guide cable 35 to force the spraying unit 12 towards the surface being cleaned while the pressure from the application of the cleaning fluids force the spraying unit 12 away from the surface being cleaned. These opposing forces stabilize the spraying unit 12, and the pressure exerted by the guide cables 35 (created by the guide cable posts extension member 212) towards the building surface keeps the spraying unit 12 in close proximity to the surface being cleaned over distances (between cable attachment points) that would not be possible without the guide cable posts extension member 212. The guide cable posts extension member 212 can be adjusted to optimize its performance on buildings of various heights.

Figure 8A:
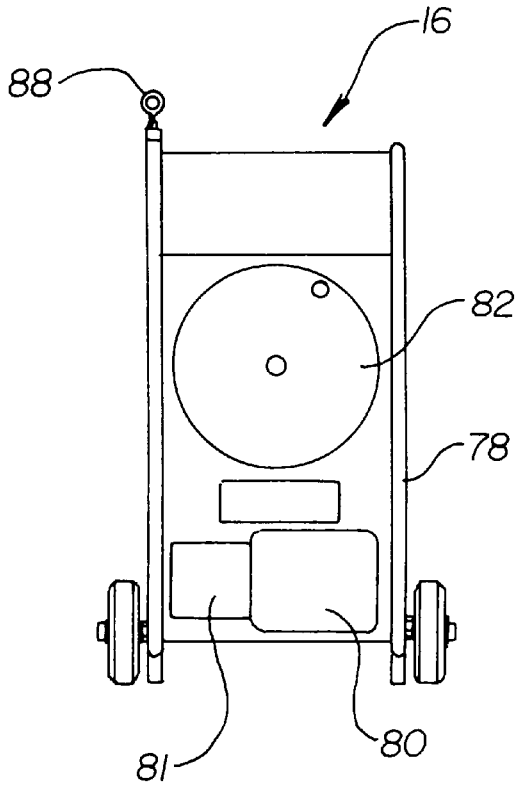
FIG. 8*a* is a side view of a bottom control unit of a washing apparatus incorporating improvements of the present invention.
Figure 8B:
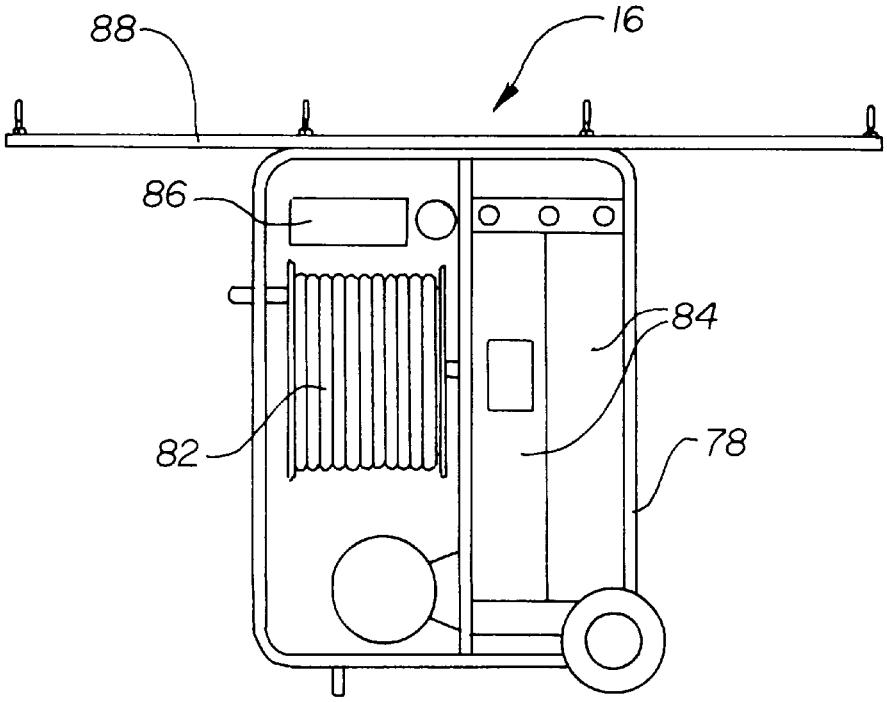
FIG. 8*b* is a front view of a bottom control unit of a washing apparatus incorporating improvements of the present invention.
Figure 12:
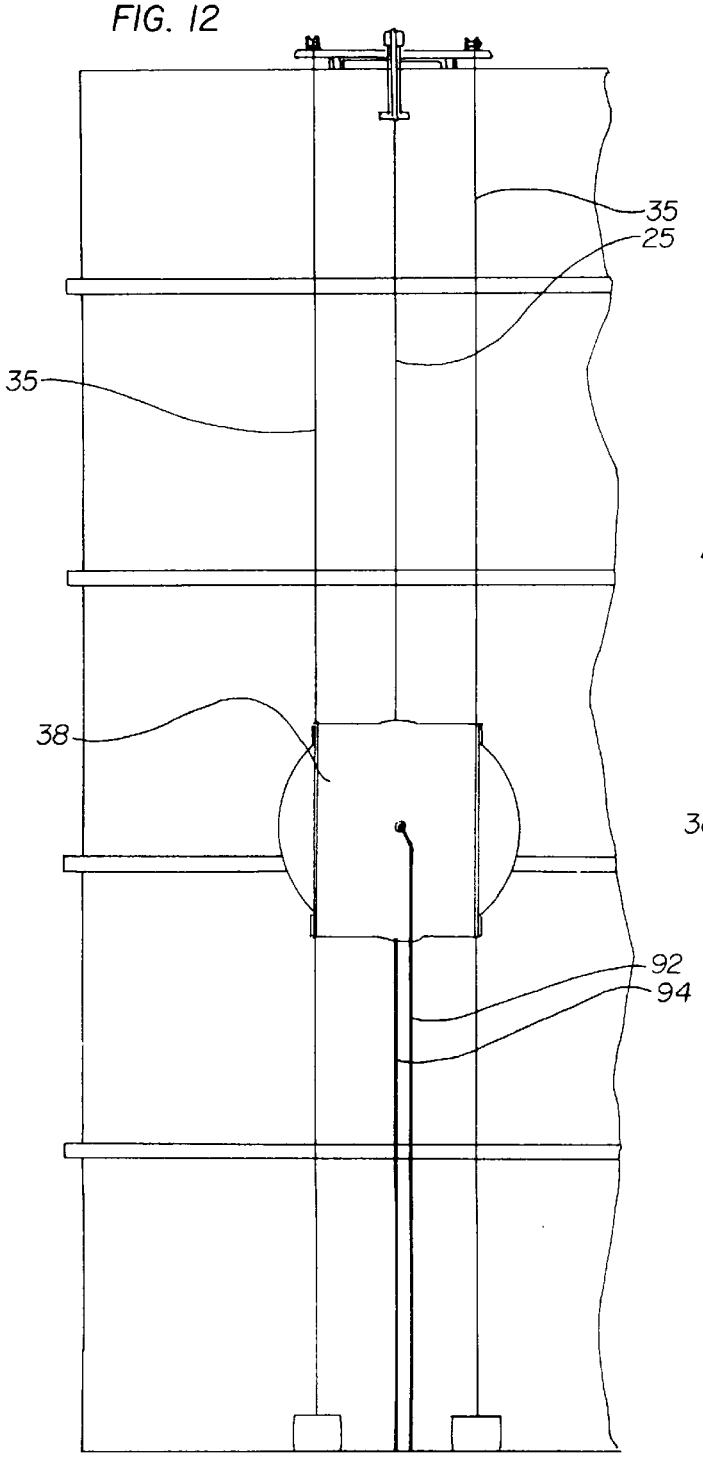
FIG. 12 is a front view of a washing apparatus of the alternative embodiment depicted in FIG. 10 cleaning the side of a building showing the spraying unit attached to the top control unit and to two weights placed on the ground.
Figure 13:
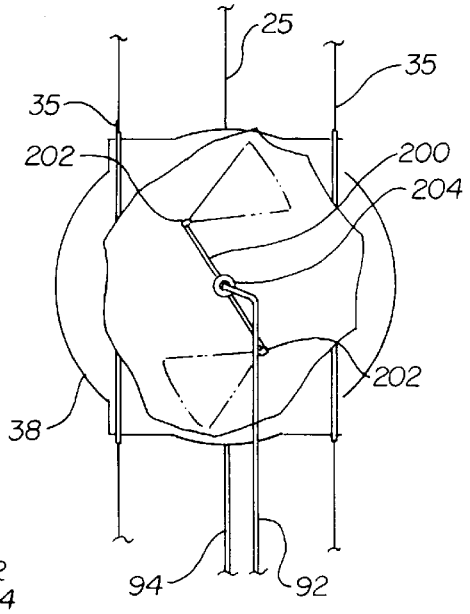
FIG. 13 is a front view of the spraying unit of the alternative embodiment depicted in FIG. 10 with the top of the housing broken away to show the spray bar and water spray pattern provided by the spray nozzles.

As shown in FIGS. 8*a* and 8*b,* the bottom control unit 16 includes a frame 78, an electrical or gas motor 80, a high pressure pump 81, a hose reel 82 including a hose 92, two fluid tanks or a dual column deionizing unit 84, a control panel 86, and a cable attachment element 88. All but the cable attachment element 88 is commercially available as one unit. As depicted in FIGS. 8*a* and 8*b,* the bottom control unit 16 is a portable purified pressure washer available from Rhino Industries, 6401 West 106th Street, Bloomington, Minn., and is identified as Model No. 8500/CW-3020DI, which is modified by adding the cable attachment element 88. Optionally, to introduce chemical cleaners into the cleaning fluid the bottom control unit 16 further includes a down stream injector. Preferably the injector can deliver two cleaning chemicals. It should be understood that wireless remote controls could be used to control the power winch 24 and the controls of the bottom control unit 16.

The cables 18 include two guide cables 35 and a lift cable 25. The lift cable 25 is attached to an eye bolt 90 connected to the spraying unit 12 and to the power winch 24. The guide cables 35 are attached to the top control unit 14 and the bottom control unit 16 and the spraying unit 12 is slidably connected to the guide cables 35 by the guide tubes 41, or the guide cable posts 205. Each guide cable 35 passes through one of the guide tubes 41 that pass through the housing 38 of the spraying unit 12, or two guide cable posts 205. As seen in FIG. 15*a,* a cable grab 99 is attached to one of the guide cables 35 and to the eye bolt 90. The cable grab 99 is a safety feature used to stop the spraying unit 12 from falling to the ground if the lift cable 25 breaks.

The hoses 20 include a water supply hose or high pressure supply hose 92 which is connected to the spraying unit 12 by an attachment fitting 40 and the bottom control unit 16 and a drain hose 94 which is connected to an attachment fitting 40 and extends from the back of the spraying unit 12 to the ground.

Figure 20:
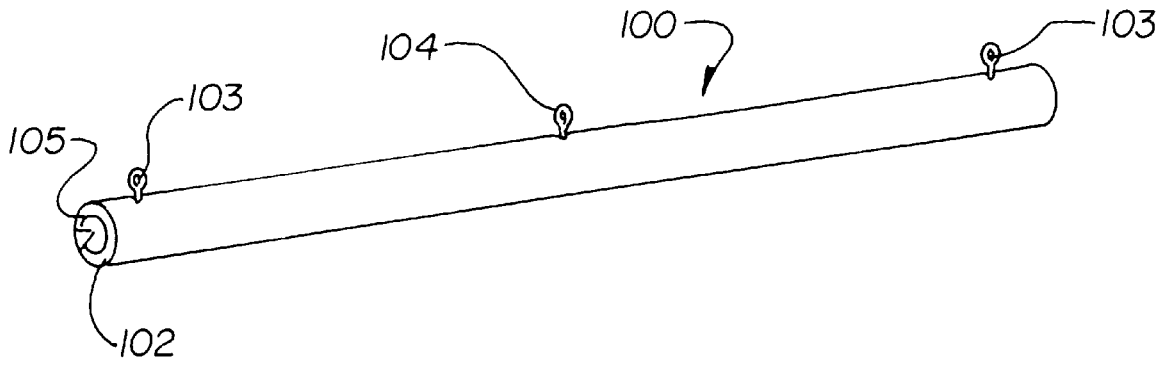
FIG. 20 is a side view of a cable spacing member.

In operation, the cables 18 are lowered to the ground and feed through the guide tubes 41, or attached to the guide cable posts 205, and are attached to the cable spacing element 88. FIG. 20 depicts a cable spacing member 100 that can be used to raise or lower all the cables 18 the ground at the same time. The cable spacing member 100 is constructed from an approximately four foot PVC pipe 102 having two eye bolts 103 mounted at its ends and an eye bolt 104 mounted at its approximate center. The pipe is wrapped in a light weight foam 105. By using the cable attachment member 100 the possibility of getting the cables 18 twisted or tangled is eliminated by keeping the ends of the cables 18 apart and moving together. The foam 105 protects the building surfaces.

The bottom control unit 16 is positioned by the user in a spaced relationship from the structure to be washed with the spraying unit 12 suspended just above it. The hand winches 22 are tightened to keep tension on the guide cables 35 so that the spraying unit 12 is positioned a selected distance from the surface being cleaned as it traverses from the bottom to the top of the structure. The tension on the guide cables 35 keeps the spraying unit 12 stable while it traverses and washes the building; even in windy conditions. It should be understood that the spraying unit 12 may occasionally make contact with the building surface, but because of the tension on the guide cables 35, the spraying unit 12 will return to its spaced relationship to the building. Because the spraying unit 12 housing 38 is made from a resilient material it will not damage the building surface. Depending on the particular embodiment of spraying unit 12 being used, the type of nozzles 50, 202, the shape and size of building projections, the water pressure being used, the wind conditions, and the height of the building being cleaned, this selected distance can range from approximately one (1) inch to three (3) feet. The spraying unit 12 is then pulled up to the top of the surfaced to be cleaned by activating the power winch 24.

The water flow starts at the water spicket on the building. A garden hose runs from a spicket of the building being cleaned to the dual column deionizer system or purified water tanks 84 to the high pressure pump 81 that increases the pressure from city water pressure of approximately 40–60 PSI to 1000–6000 PSI. The water then flows up the water supply hose 92, which is on the hose reel 82 and is attached by a quick connect fitting to the spraying unit 12. With reference to the spraying unit 12 depicted in FIGS. 1–9, the deionized or purified water flows through the tubing 52 and control valves shown in FIGS. 3 and 4 into the spray bars 48 and through the nozzles 50. With reference to the spraying units 12 depicted in FIGS. 10–17, the pressurized fluid flows directly into the spray bar 200 and through the nozzles 202.

With further reference to the spraying unit 12 of FIGS. 1–9, in that embodiment, the water flows from the high pressure regulator 54 to the rinse spray bar 64 then through the pulsating nozzles 70 to the surface to be cleaned. Because of the loss of water pressure caused by multiple spray tubes and nozzles, as well as loss due to gravity and friction, the high pressure regulator 54 is used to maintain the same pressure going up the building regardless of the height of the building. As stated above, control valve 60 is typically left open. Also, on the other side of the high pressure regulator 54 the water pressure to the soapy water spray bar 62 and to the final rinse water spray bar is reduced to 40–250 PSI by flow control valves 58, 56, respectively. The low pressure of the water flowing to the soapy water spray bar 62 creates a vacuum and thereby pulls soap through the siphon unit 57 from the soap dispenser 46.

The nozzles 50 on all the spray tubes 48 are selected to maximize the objective of each fluid. With respect to the oscillating spray nozzles 68, the nozzles 68 are selected to maximize the impact of the soap on the cleaning surface. With respect to the pulsating nozzles 70, the nozzles 70 are selected to maximize their coverage over the area covered with cleaning fluid and to maximize their squeegee-like effect. With respect to the fan type nozzles 76, the nozzles 76 are selected to maximize the flushing away of any remaining dirt and soap down the building and to leave behind a sheet of uncontaminated deionized water that will dry spot free.

Finally, regardless of the embodiment being used, the user activates the power winch 24 which unwinds the lift cable 25 so that the spraying unit 12 traverses the building 11 in a downward direction at a controlled rate of speed. Upon reaching the bottom of the surface of the building being cleaned the user terminates the flow of water to the spraying unit 12, moves the top control unit 14 and bottom control unit 16 over to the next section of the building 11 to be cleaned and activates the power winch 24 so that it retrieves the lift cable 25 thereby lifting the spraying unit 12 to the top of the building surface to be cleaned. The process discussed above is then repeated until the entire surface of the building being cleaned is cleaned to the users satisfaction.

The 110 volt power winch 24 lifts and lowers the spray unit 12 in a vertical line substantially parallel to the building or wall at a controlled speed. The speed is determined on how clean the surface is. If the surface is relatively clean the speed may be 55–80 feet per minute; if the surface is relatively dirty the speed would be slowed down to approximately 30–55 feet per minute. It should be understood that the speed is adjusted to achieve the best cleaning quality. It should be understood that the flow of water or other cleaning fluid could be turned before the spraying unit 12 is pulled up to the top of the structure being cleaned to presoak the surface, or so that the it is used to clean in both directions.

Although a description of the preferred embodiments have been presented, it is contemplated that various changes, including those mentioned above, could be made without deviating from the spirit of the present invention. For example, the present invention could be modified and used for painting or for stripping paint with high pressure water. It should understood that fluids other than paint or water could be used with the present invention and fluids of various temperature ranges could be used to enhance or accomplish the user's objectives. Aspects of the present invention could also be used to provide a vehicle to perform tasks unrelated to exterior building maintenance. For instance, by removing the cleaning elements and mounting a remote camera within or on the housing 38, unmanned surveillance and inspection tasks could be performed.

Figure 19:
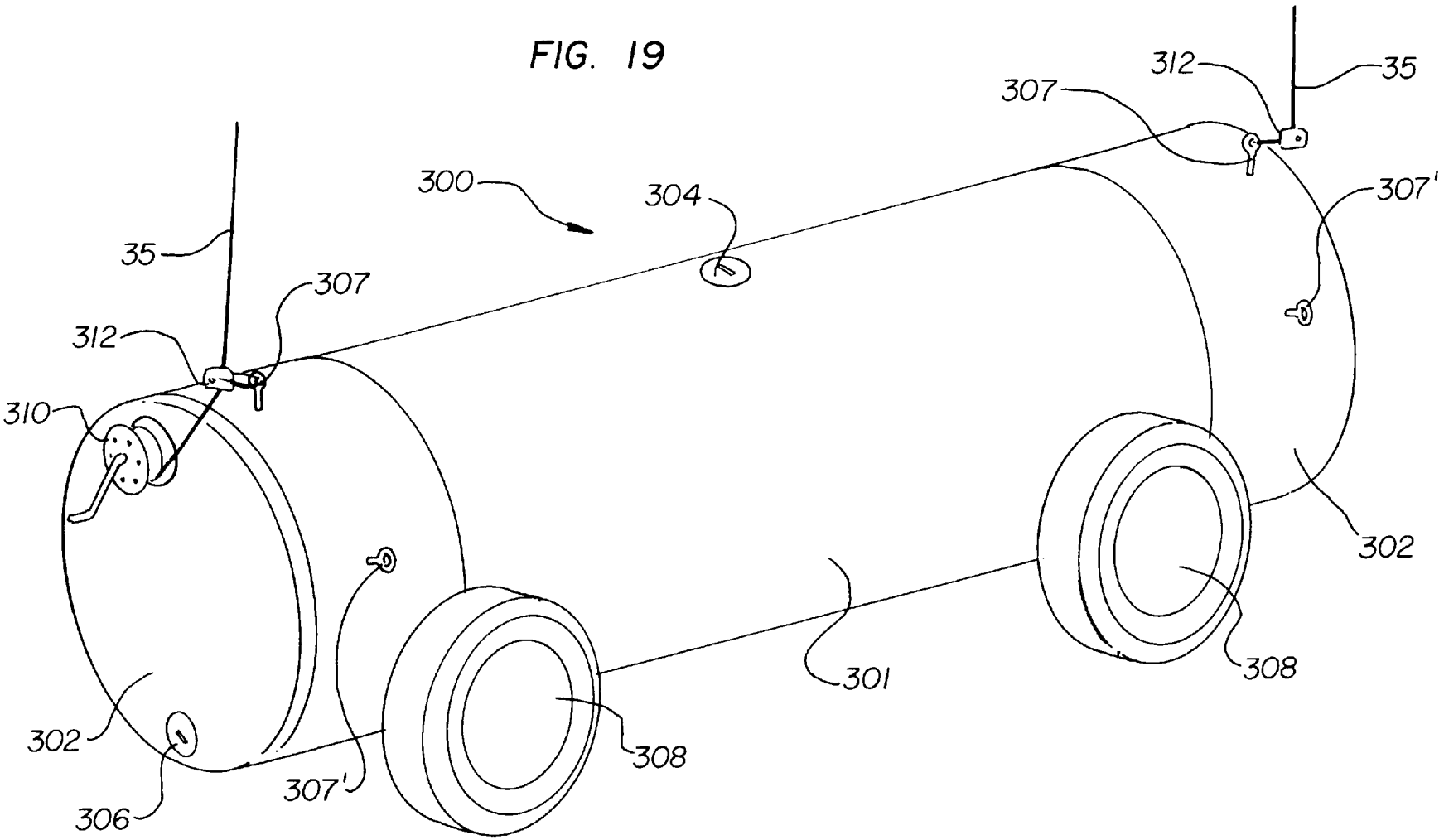
FIG. 19 is an isometric view of a rolling fillable tube that can be used to secure the bottom ends of the guide cables.

A variation of the present invention may be to anchor the guide cables 35 with weights, a rolling weighted cart, or anchoring devices such as ground augers or suction cups, thereby allowing the bottom control unit 16 (i.e., the motor 80, the high pressure pump 81, the hose reel 82, two fluid tanks or a dual column deionizing unit 84, the control panel 86, and the frame 78) to be placed on the top of the building or at any appropriate location on the ground, or left on a vehicle. One such variation is a rolling fillable tube 300 to anchor the guide cables 35 as depicted in FIG. 19. Preferably the tube 300 is twelve inch PVC pipe 301 that is four feet to six feet long that has two airtight caps 302 that seal the two ends of the pipe so that it can hold either water or sand (or any other flowable material). The tube 300 includes a fill hole that is sealed with a fill plug 304, and one or both of the caps 302 include a drain hole sealed with a drain plug(s) 306. Two or more eye bolts 307 are connected to each cap to which the guide cables 35 are attached. Eye bolts 307' are used when the user wants the guide cables 35 to be as close the surface being cleaned as possible. Based on the above given dimensions, the tube 300 has an approximate holding capacity of 30–45 gals of water or 300–400 pounds. The tube 300 further includes four air wheels 308. The fill and drain holes allow the tube 300 to be quickly and easily filled and drained so that it can be easily transported. Because of the wheels 308, one person can easily roll the tube 300 whether its empty or full. An optional feature that can be added to the tube 300 is two winches 310. A pulley having a quick clip 312 is connected to each eyebolt 307 and each guide cable 35 passes through a pulley 312 and is connected to a winch 310. Preferably two winches like the DL600 winches sold by Dutton Lainson Company of Hastings, Nebr. are used, but any commercially available winch may be suitable. These winches are used to keep the machine close to the surface being cleaned, even in windy conditions, by enabling the user to reel in small amounts of guide cable 35 during the cleaning process. Because the tension of the guide cables 35 can also be adjusted from the ground, the ground operator can make minor adjustments to control the spraying unit 12 without having enlist the assistance of the operator on the top of the building.

Figure 21:
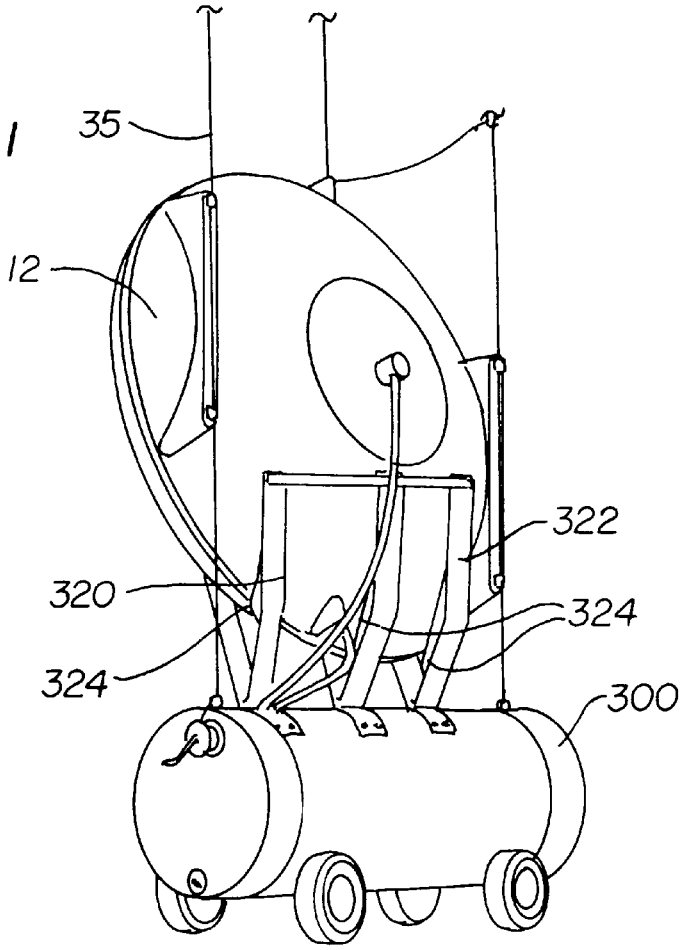
FIG. 21 is an isometric view of a spraying unit receiving component connected to the rolling fillable tube of FIG. 19.

As seen in FIG. 21, a spraying unit receiving component 320 could be removably mounted on the top of the rolling fillable tube 300. The receiving component 320 includes a frame 322 that is designed to generally correspond to the shape of the spraying unit's 12 housing 38, and a number of elongated elastic members 324 connected to the frame 322. When the spraying unit 12 contacts the elastic members 324, they stretch as they slow the spraying unit's 12 rate of descent towards the rolling fillable tube 300. The number and strength of the elastic members 324 are selected so that they stop the descent of the spraying unit when it is in close proximity to the frame 322. The frame 322 will support and stabilize the spraying unit 12 as it and the rolling fillable tube 200 are pushed to the next section of the structure to be cleaned.

Still another variation may be to replace the lift cable 25 and guide cables 35 with two chain and sprocket assemblies on each side of the housing 38 as depicted in FIGS. 9 and 9*a*, which also functions to maintain the spraying unit 12 an optimal distance from the surface of the building being cleaned and to cause the spraying unit 12 to traverse up and down the building. Each chain 400 weaves through a plurality of sprockets 402; the drive sprocket 403 being connected to a motor 404. A robotic washing apparatus having such a chain and sprocket assembly is described in copending application Ser. No. 08/790,464 which is hereby incorporated by reference. It should be understood that one chain and sprocket assembly connected to the approximate centerline of the spraying unit 12 may used in combination with other stabilizing elements, instead of the two chain and sprocket assemblies shown in FIGS. 9 and 9*a*. One of the advantages of using the chain and sprocket assembly is that the speed of the spraying unit 12 can be more variably and adjustably controlled by a variable speed motor that drives a drive sprocket.

Yet another variation may be to attach a generally straight brush along the length of the spray bar 200 and/or conically shaped brushes surrounding each nozzle 202. Still yet another variation may be to eliminate the spray bar 200 and swivel 204, and use a single spiral nozzle rotatably connected to the center of the spraying unit 12 housing 38. An example of a spiral nozzle is the SpiralJet® sold by Spray Systems Company, Wheaton, Ill.

I claim:

1. An apparatus for performing nonmanual tasks adjacent vertical surfaces, said apparatus comprising:

a top control unit including a moveable carriage, two stability winches mounted to said carriage, and a lift winch mounted to said carriage;

a vehicle including a housing having a length and two elongated guide tubes fixedly connected to said housing, said guide tubes having a length generally equal to the length of said housing;

a bottom control unit including at least two bottom control winches;

two elongated flexible members each having a first end and a second end, said first end of each said elongated flexible members being operably connected to one of said stability winches and said second end of each said elongated flexible members being operably connected to one of said bottom control winches, further each said flexible members passing through, and being slidably retained by, one of said guide tubes; and a lift cable having a first end and a second end, said first end of said lift cable being operably connected to said lift winch and said second end of said lift cable being operably connected to said vehicle.

2. The apparatus of claim 1, wherein said vehicle includes at least one fluid spray bar.

3. The apparatus of claim 2, further comprising a hose and a fluid pump, and wherein said hose is connected to said at least one said fluid spray bar and said fluid pump.

4. The apparatus of claim 1, wherein said vehicle further includes a stabilizer bar.

5. The apparatus of claim 4, wherein the bottom control unit further includes wheels, a frame that generally corresponds to the shape of said vehicle, and a plurality of elongated elastic members connected to said frame.

6. An apparatus for applying fluids to the exterior surfaces of vertical or nearly vertical structures nonmanually, said apparatus comprising:

a top control unit including a moveable carriage, two stability winches mounted to said carriage, and a lift winch mounted to said carriage;

a spraying unit having a housing having a length, two elongated guide tubes fixedly connected to said housing, said guide tubes having a length generally equal to the length of said housing, and a spray bar rotatably mounted on said housing and having at least one high pressure liquid spray nozzle, said at least one high pressure nozzle being mounted on said spray bar such that a fluid being sprayed through at least one nozzle causes said bar to move relative to the structure;

a bottom control unit including at least two bottom control winches;

two elongated flexible members each having a first end and a second end, said first end of each said elongated flexible members being operably connected to one of said stability winches and said second end of each said elongated flexible members being operably connected to one of said bottom control winches, further each said flexible members passing through, and being slidably retained by, one of said guide tubes; and a lift cable having a first end and a second end, said first end of said lift cable being operably connected to said lift winch and said second end of said lift cable being operably connected to said vehicle.

7. The apparatus of claim 6, wherein said spraying unit has a leading side, trailing side and two lateral sides, and further includes a sprocket assembly mounted on each lateral side, said two elongated flexible members are chains, and each said chain is operably connected to one of said sprocket assemblies.

8. The apparatus of claim 7, further comprising a hose and a fluid pump, and wherein said hose is connected to said at least one said fluid spray bar and said fluid pump.

9. The apparatus of claim 5, further comprising a hose and a high pressure fluid pump, and wherein said hose is connected to said at least one said fluid spray bar and said high pressure fluid pump.

10. The apparatus of claim 9, wherein said fluid being sprayed through at least one high pressure nozzle is under pressure of at least 250 PSI and causes said spray bar to spin.

11. The apparatus of claim 9, wherein said fluid being sprayed through at least one high pressure nozzle is under pressure of at least 250 PSI and forces said spraying unit away from the structure.

12. The apparatus of claim 9, wherein said fluid being sprayed through at least one high pressure nozzle is under pressure of at least 250 PSI and forces said spraying unit away from the structure, and causes said spray bar to spin.

13. The apparatus of claim 12, wherein the bottom control unit further includes wheels, a frame that generally corresponds to the shape of said vehicle, and a plurality of elongated elastic members connected to said frame.

14. The apparatus of claim 13, wherein said vehicle further includes a stabilizer bar.

15. The apparatus of claim 14, wherein the bottom control unit further includes wheels, a frame that generally corresponds to the shape of said vehicle, and a plurality of elongated elastic members connected to said frame.

16. The apparatus of claim 6, wherein said spraying unit has a cleaning fluid spray bar, a rinse spray bar, and deionized spray bar.

17. The apparatus of claim 6, wherein said spraying unit has a cleaning fluid spray bar and a rinse spray bar.

18. The apparatus of claim 6, wherein said spraying unit further has a swivel connected to said housing and said spray bar is rotatably mounted at its center to said swivel.

19. The apparatus of claim 6, wherein said vehicle further includes a stabilizer bar.

20. The apparatus of claim 6, wherein the bottom control unit further includes wheels, a frame that generally corresponds to the shape of said vehicle, and a plurality of elongated elastic members connected to said frame.

21. An apparatus for performing nonmanual tasks adjacent vertical surfaces, said apparatus comprising:

a top control unit including a moveable carriage, two stability winches mounted to said carriage, and a lift winch mounted to said carriage;

a vehicle including a housing having a length and two elongated guide tubes fixedly connected to said housing, said guide tubes having a length substantially equal to than the length of said housing;

a bottom control unit having a body and two connection points;

two elongated flexible members each having a first end and a second end, said first end of each said elongated flexible members being operably connected to one of said stability winches and said second end of each said elongated flexible members being operably connected to one of said connection points, further each said flexible members passing through, and being slidably retained by, one of said guide tubes; and a lift cable having a first end and a second end, said first end of said lift cable being operably connected to said lift winch and said second end of said lift cable being operably connected to said vehicle.

* * * * *

UNITED STATES PATENT AND TRADEMARK OFFICE

CERTIFICATE OF CORRECTION

PATENT NO. : 5,901,720

DATED : May 11, 1999

INVENTOR(S) : Michael R. Lange

It is certified that error appears in the above-indentified patent and that said Letters Patent is hereby corrected as shown below:

In column 2, line 49, please delete the words "and method".

Signed and Sealed this

Twelfth Day of October, 1999

*Attest:*

Q. TODD DICKINSON

*Attesting Officer*

*Acting Commissioner of Patents and Trademarks*